US007213811B2

(12) United States Patent
Bozeman

(10) Patent No.: US 7,213,811 B2
(45) Date of Patent: May 8, 2007

(54) EXTENSION TO A LOTTERY GAME FOR WHICH WINNING INDICIA ARE SET BY SELECTIONS MADE BY WINNERS OF A BASE LOTTERY GAME

(75) Inventor: Alan Kyle Bozeman, Alpharetta, GA (US)

(73) Assignee: Scientific Games Royalty Corporation, Newark, DE (US)

( * ) Notice: Subject to any disclaimer, the term of this patent is extended or adjusted under 35 U.S.C. 154(b) by 0 days.

(21) Appl. No.: 11/296,064

(22) Filed: Dec. 7, 2005

(65) Prior Publication Data

US 2006/0119034 A1 Jun. 8, 2006

Related U.S. Application Data

(60) Provisional application No. 60/634,210, filed on Dec. 8, 2004.

(51) Int. Cl.
*A63F 3/06* (2006.01)

(52) U.S. Cl. ..... 273/139; 273/274; 273/138.1; 273/138.2; 463/17; 463/18; 283/903

(58) Field of Classification Search ..... 273/139, 273/138.1, 274; 463/17, 18, 19; 274/138, 274/138.1, 274, 269; 283/903, 901
See application file for complete search history.

(56) References Cited

U.S. PATENT DOCUMENTS 1,527,929 A 2/1925 Simons
3,089,123 A 5/1963 Hennis et al.
3,245,697 A 4/1966 Nugent
3,699,311 A 10/1972 Dunbar
3,736,368 A 5/1973 Vogelman et al.

(Continued)

FOREIGN PATENT DOCUMENTS

AU B-18428/92 12/1992

(Continued)

OTHER PUBLICATIONS

'Are You In?', (Article).

(Continued)

*Primary Examiner*—Benjamin Layno
(74) *Attorney, Agent, or Firm*—Carlton Fields, PA; Li K. Wang

(57) ABSTRACT

A system and method of playing an extension game to a lottery game is disclosed. A lottery game player enters a base game and receives a base game entry, and may elect to play a second lottery game in addition to the base game, and if so, selects or has selected for them game indicia therefor. A winning entry for the base game is selected, whereupon the winning game indicia for the second game is selected to be the game indicia selected for the second game on the winning base game entry. Lottery players who won the base game receive a prize, and those lottery players who did not win the base game but that have the winning game indicia for the second game, as well as those lottery players that won the base game and have the have the winning game indicia for the second game, receive a prize.

22 Claims, 18 Drawing Sheets

U.S. PATENT DOCUMENTS

| | | | | | |
|---|---|---|---|---|---|
| 3,826,499 | A | | 7/1974 | Lenkoff | |
| 3,868,057 | A | | 2/1975 | Chavez | |
| 3,876,865 | A | | 4/1975 | Bliss | |
| 3,902,253 | A | | 9/1975 | Sabuzawa et al. | |
| 3,918,174 | A | | 11/1975 | Miller et al. | |
| 3,922,529 | A | | 11/1975 | Orloff | |
| 3,934,120 | A | | 1/1976 | Maymarev | |
| 4,017,834 | A | | 4/1977 | Cuttill et al. | |
| 4,095,824 | A | | 6/1978 | Bachman | |
| 4,105,156 | A | | 8/1978 | Dethloff | |
| 4,176,406 | A | | 11/1979 | Matkan | |
| 4,191,376 | A | | 3/1980 | Goldman et al. | |
| 4,194,296 | A | | 3/1980 | Pagnozzi et al. | |
| 4,195,772 | A | | 4/1980 | Nishimura | |
| 4,206,920 | A | | 6/1980 | Weatherford et al. | |
| 4,241,942 | A | | 12/1980 | Bachman | |
| 4,243,216 | A | | 1/1981 | Mazumder | |
| 4,273,362 | A | | 6/1981 | Carrier et al. | |
| 4,309,452 | A | | 1/1982 | Sachs | |
| 4,313,087 | A | | 1/1982 | Weitzen et al. | |
| 4,355,300 | A | | 10/1982 | Weber | |
| 4,375,666 | A | | 3/1983 | Buck et al. | |
| 4,398,708 | A | | 8/1983 | Goldman et al. | |
| 4,407,443 | A | | 10/1983 | McCorkle | |
| 4,451,759 | A | | 5/1984 | Heynisch | |
| 4,455,039 | A | | 6/1984 | Weitzen et al. | |
| 4,457,430 | A | | 7/1984 | Darling et al. | |
| 4,464,423 | A | | 8/1984 | LaBianca et al. | |
| 4,466,614 | A | | 8/1984 | Bachman et al. | |
| 4,488,646 | A | | 12/1984 | McCorkle | |
| 4,491,319 | A | | 1/1985 | Nelson | |
| 4,494,197 | A | | 1/1985 | Troy et al. | |
| 4,536,218 | A | | 8/1985 | Ganho | |
| 4,544,184 | A | | 10/1985 | Freund et al. | |
| 4,579,371 | A | | 4/1986 | Long et al. | |
| 4,591,189 | A | | 5/1986 | Holmen et al. | |
| 4,634,149 | A | | 1/1987 | Donovan | |
| 4,665,502 | A | | 5/1987 | Kreisner | |
| 4,669,729 | A | | 6/1987 | Solitt et al. | |
| 4,689,742 | A | | 8/1987 | Troy et al. | |
| 4,726,608 | A | | 2/1988 | Walton | |
| 4,736,109 | A | | 4/1988 | Dvorzsak | |
| 4,740,016 | A | | 4/1988 | Konecny et al. | |
| 4,760,247 | A | | 7/1988 | Keane et al. | |
| 4,763,927 | A | | 8/1988 | Schneider | |
| 4,775,155 | A | | 10/1988 | Lees | |
| 4,792,667 | A | | 12/1988 | Chen | |
| 4,805,907 | A | | 2/1989 | Hagiwara | |
| 4,817,951 | A | | 4/1989 | Crouch et al. | |
| 4,835,624 | A | | 5/1989 | Black et al. | |
| 4,836,546 | A | | 6/1989 | Dire et al. | |
| 4,836,553 | A | | 6/1989 | Suttle et al. | |
| 4,837,728 | A | | 6/1989 | Barrie et al. | |
| 4,842,278 | A | * | 6/1989 | Markowicz | 463/18 |
| 4,856,787 | A | | 8/1989 | Itkis | |
| 4,861,041 | A | | 8/1989 | Jones et al. | |
| 4,870,260 | A | | 9/1989 | Niepolomski et al. | |
| 4,880,964 | A | | 11/1989 | Donahue | |
| 4,888,964 | A | | 12/1989 | Klinge | |
| 4,922,522 | A | | 5/1990 | Scanlon | |
| 4,943,090 | A | | 7/1990 | Fienberg | |
| 4,960,611 | A | | 10/1990 | Fujisawa et al. | |
| 4,961,578 | A | | 10/1990 | Chateau | |
| 4,964,642 | A | | 10/1990 | Kamille | |
| 4,996,705 | A | | 2/1991 | Entenmann et al. | |
| 4,998,010 | A | | 3/1991 | Chandler et al. | |
| 4,998,199 | A | | 3/1991 | Tashiro et al. | |
| 5,032,708 | A | | 7/1991 | Comerford et al. | |
| 5,037,099 | A | | 8/1991 | Burtch | |
| 5,046,737 | A | | 9/1991 | Fienberg | |
| 5,074,566 | A | | 12/1991 | Desbiens | |
| 5,083,815 | A | | 1/1992 | Scrymgeour et al. | |
| 5,092,598 | A | | 3/1992 | Kamille | |
| 5,094,458 | A | | 3/1992 | Kamille | |
| 5,100,139 | A | | 3/1992 | Di Bella | |
| 5,109,153 | A | | 4/1992 | Johnson et al. | |
| 5,112,050 | A | | 5/1992 | Koza et al. | |
| 5,116,049 | A | | 5/1992 | Sludikoff et al. | |
| 5,118,109 | A | | 6/1992 | Gumina | |
| 5,119,295 | A | | 6/1992 | Kapur | |
| 5,129,652 | A | * | 7/1992 | Wilkinson | 273/139 |
| 5,158,293 | A | * | 10/1992 | Mullins | 273/139 |
| 5,165,967 | A | | 11/1992 | Theno et al. | |
| 5,186,463 | A | | 2/1993 | Marin et al. | |
| 5,189,292 | A | | 2/1993 | Batterman et al. | |
| 5,193,815 | A | | 3/1993 | Pollard | |
| 5,193,854 | A | | 3/1993 | Borowski, Jr. et al. | |
| 5,228,692 | A | | 7/1993 | Carrick et al. | |
| 5,232,221 | A | | 8/1993 | Sludikoff et al. | |
| 5,234,798 | A | | 8/1993 | Heninger et al. | |
| 5,249,801 | A | | 10/1993 | Jarvis | |
| 5,259,616 | A | | 11/1993 | Bergmann | |
| 5,273,281 | A | | 12/1993 | Lovell | |
| 5,276,980 | A | | 1/1994 | Carter et al. | |
| 5,282,620 | A | | 2/1994 | Keesee | |
| 5,308,992 | A | | 5/1994 | Crane et al. | |
| 5,317,135 | A | | 5/1994 | Finocchio | |
| 5,326,104 | A | | 7/1994 | Pease et al. | |
| 5,332,219 | A | | 7/1994 | Marnell, II et al. | |
| 5,342,047 | A | | 8/1994 | Heidel et al. | |
| 5,342,049 | A | | 8/1994 | Wichinsky et al. | |
| 5,344,144 | A | | 9/1994 | Canon | |
| 5,346,258 | A | | 9/1994 | Behn et al. | |
| 5,380,007 | A | | 1/1995 | Travis et al. | |
| 5,393,057 | A | | 2/1995 | Marnell, II et al. | |
| 5,401,024 | A | | 3/1995 | Simunek | |
| 5,403,039 | A | | 4/1995 | Borowski, Jr. et al. | |
| 5,407,199 | A | | 4/1995 | Gumina | |
| 5,420,406 | A | | 5/1995 | Izawa et al. | |
| 5,432,005 | A | | 7/1995 | Tanigami et al. | |
| 5,451,052 | A | | 9/1995 | Behm et al. | |
| 5,456,465 | A | | 10/1995 | Durham | |
| 5,456,602 | A | | 10/1995 | Sakuma | |
| 5,470,156 | A | | 11/1995 | May | |
| 5,471,040 | A | | 11/1995 | May | |
| 5,472,196 | A | * | 12/1995 | Rusnak | 463/18 |
| 5,475,205 | A | | 12/1995 | Behm et al. | |
| 5,486,005 | A | | 1/1996 | Neal | |
| 5,513,846 | A | | 5/1996 | Niederlein et al. | |
| 5,528,154 | A | | 6/1996 | Leichner et al. | |
| 5,536,016 | A | | 7/1996 | Thompson | |
| 5,540,442 | A | | 7/1996 | Orselli et al. | |
| 5,548,110 | A | | 8/1996 | Storch et al. | |
| 5,550,746 | A | | 8/1996 | Jacobs | |
| 5,560,610 | A | | 10/1996 | Behm et al. | |
| 5,564,700 | A | | 10/1996 | Celona | |
| 5,564,977 | A | | 10/1996 | Algie | |
| 5,591,956 | A | | 1/1997 | Longacre, Jr. et al. | |
| 5,599,046 | A | | 2/1997 | Behm et al. | |
| 5,602,381 | A | | 2/1997 | Hoshino et al. | |
| 5,621,200 | A | | 4/1997 | Irwin et al. | |
| 5,628,684 | A | | 5/1997 | Bouedec | |
| 5,630,753 | A | | 5/1997 | Fuchs | |
| 5,651,735 | A | | 7/1997 | Baba | |
| 5,655,961 | A | | 8/1997 | Acres et al. | |
| 5,667,250 | A | | 9/1997 | Behm et al. | |
| 5,682,819 | A | | 11/1997 | Beatty | |
| 5,690,366 | A | | 11/1997 | Luciano | |
| RE35,684 | E | | 12/1997 | Maeng | |
| 5,704,647 | A | | 1/1998 | Desbiens | |
| 5,722,891 | A | | 3/1998 | Inoue | |
| 5,726,898 | A | | 3/1998 | Jacobs | |
| 5,732,948 | A | | 3/1998 | Yoseloff | |
| 5,741,183 | A | | 4/1998 | Acres et al. | |

| | | | |
|---|---|---|---|
| 5,743,800 | A | 4/1998 | Huard et al. |
| 5,752,882 | A | 5/1998 | Acres et al. |
| 5,756,220 | A | 5/1998 | Hoshino et al. |
| 5,768,142 | A | 6/1998 | Jacobs |
| 5,769,458 | A | 6/1998 | Carides et al. |
| 5,770,533 | A | 6/1998 | Franchi |
| 5,772,509 | A | 6/1998 | Weiss |
| 5,772,510 | A | 6/1998 | Roberts |
| 5,772,511 | A | 6/1998 | Smeltzer |
| 5,779,840 | A | 7/1998 | Boris |
| 5,789,459 | A | 8/1998 | Inagaki et al. |
| 5,791,990 | A | 8/1998 | Schroeder et al. |
| 5,797,794 | A | 8/1998 | Angell |
| 5,803,504 | A | 9/1998 | Deshiens et al. |
| 5,816,920 | A | 10/1998 | Hanai |
| 5,818,019 | A | 10/1998 | Irwin, Jr. et al. |
| 5,820,459 | A | 10/1998 | Acres et al. |
| 5,823,874 | A | 10/1998 | Adams |
| 5,830,063 | A | 11/1998 | Byrne |
| 5,830,066 | A | 11/1998 | Goden et al. |
| 5,830,067 | A | 11/1998 | Graves et al. |
| 5,833,537 | A | 11/1998 | Barrie |
| 5,835,576 | A | 11/1998 | Katz |
| 5,836,086 | A | 11/1998 | Elder |
| 5,836,817 | A | 11/1998 | Acres et al. |
| 5,848,932 | A | 12/1998 | Adams |
| 5,863,075 | A | 1/1999 | Rich et al. |
| 5,871,398 | A | 2/1999 | Schneier et al. |
| 5,876,284 | A | 3/1999 | Acres et al. |
| 5,882,261 | A | 3/1999 | Adams |
| 5,883,537 | A | 3/1999 | Luoni et al. |
| 5,885,158 | A | 3/1999 | Torango et al. |
| 5,887,906 | A | 3/1999 | Sultan |
| 5,903,340 | A | 5/1999 | Lawandy et al. |
| 5,911,418 | A | 6/1999 | Adams |
| 5,915,588 | A | 6/1999 | Stoken et al. |
| 5,934,671 | A | 8/1999 | Harrison |
| 5,970,143 | A | 10/1999 | Schneier et al. |
| 5,979,894 | A | 11/1999 | Alexoff |
| 5,996,997 | A | 12/1999 | Kamille |
| 5,997,044 | A | 12/1999 | Behm et al. |
| 6,003,307 | A | 12/1999 | Naber et al. |
| 6,004,207 | A | 12/1999 | Wilson, Jr. et al. |
| 6,007,162 | A | 12/1999 | Hinz et al. |
| 6,012,982 | A | 1/2000 | Piechowiak et al. |
| 6,014,032 | A | 1/2000 | Maddix et al. |
| 6,017,032 | A | 1/2000 | Grippo et al. |
| 6,024,641 | A | 2/2000 | Sarno |
| 6,053,405 | A | 4/2000 | Irwin, Jr. et al. |
| 6,077,162 | A | 6/2000 | Weiss |
| 6,080,062 | A | 6/2000 | Olson |
| 6,086,477 | A | 7/2000 | Walker et al. |
| 6,089,978 | A | 7/2000 | Adams |
| 6,099,407 | A | 8/2000 | Parker, Jr. et al. |
| 6,102,400 | A | 8/2000 | Scott et al. |
| 6,107,913 | A | 8/2000 | Gatto et al. |
| 6,119,364 | A | 9/2000 | Elder |
| 6,125,368 | A | 9/2000 | Bridge et al. |
| 6,142,872 | A | 11/2000 | Walker et al. |
| 6,146,272 | A | 11/2000 | Walker et al. |
| 6,149,521 | A | 11/2000 | Sanduski |
| 6,155,491 | A | 12/2000 | Dueker et al. |
| 6,168,521 | B1 | 1/2001 | Luciano et al. |
| 6,168,522 | B1 | 1/2001 | Walker et al. |
| 6,179,710 | B1 | 1/2001 | Sawyer et al. |
| 6,203,430 | B1 | 3/2001 | Walker et al. |
| 6,206,373 | B1 | 3/2001 | Garrod |
| 6,210,275 | B1 | 4/2001 | Olsen |
| 6,217,448 | B1 | 4/2001 | Olsen |
| 6,220,596 | B1 | 4/2001 | Walker et al. |
| 6,220,961 | B1 | 4/2001 | Keane et al. |
| 6,224,055 | B1 | 5/2001 | Walker et al. |
| 6,227,969 | B1 | 5/2001 | Yoseloff |
| 6,238,288 | B1 | 5/2001 | Walker et al. |
| 6,309,300 | B1 | 10/2001 | Glavich |
| 6,312,334 | B1 | 11/2001 | Yoseloff |
| 6,315,291 | B1 | 11/2001 | Moody |
| 6,330,976 | B1 | 12/2001 | Dymetman et al. |
| 6,331,143 | B1 | 12/2001 | Yoseloff |
| 6,334,814 | B1 | 1/2002 | Adams |
| 6,340,158 | B2 | 1/2002 | Pierce et al. |
| 6,368,213 | B1 | 4/2002 | McNabola |
| 6,375,568 | B1 | 4/2002 | Roffman et al. |
| 6,379,742 | B1 | 4/2002 | Behm et al. |
| 6,394,899 | B1 | 5/2002 | Walker |
| 6,398,214 | B1 | 6/2002 | Moteki et al. |
| 6,398,643 | B1 | 6/2002 | Knowles et al. |
| 6,398,644 | B1 | 6/2002 | Perrie et al. |
| 6,398,645 | B1 | 6/2002 | Yoseloff |
| 6,416,408 | B2 | 7/2002 | Tracy et al. |
| 6,419,579 | B1 | 7/2002 | Bennett |
| 6,435,408 | B1 | 8/2002 | Irwin, Jr. et al. |
| 6,435,500 | B2 | 8/2002 | Gumina |
| 6,478,677 | B1 | 11/2002 | Moody |
| 6,491,215 | B1 | 12/2002 | Irwin, Jr. et al. |
| 6,497,408 | B1 | 12/2002 | Walker et al. |
| 6,552,290 | B1 | 4/2003 | Lawandy |
| 6,588,747 | B1 | 7/2003 | Seelig |
| 6,599,186 | B1 | 7/2003 | Walker et al. |
| 6,601,772 | B1 | 8/2003 | Rubin et al. |
| 6,637,747 | B1 | 10/2003 | Garrod |
| 6,648,735 | B2 | 11/2003 | Miyashita et al. |
| 6,648,753 | B1 | 11/2003 | Tracy et al. |
| 6,648,755 | B1 | 11/2003 | Luciano et al. |
| 6,676,126 | B1 | 1/2004 | Walker et al. |
| 6,692,354 | B2 | 2/2004 | Tracy et al. |
| 6,702,047 | B2 | 3/2004 | Huber |
| 6,773,345 | B2 | 8/2004 | Walker et al. |
| 6,776,337 | B2 | 8/2004 | Irwin, Jr. et al. |
| 6,786,824 | B2 | 9/2004 | Cannon |
| 6,823,874 | B2 | 11/2004 | Lexcen |
| 6,875,105 | B1 | 4/2005 | Behm et al. |
| 6,929,186 | B2 | 8/2005 | Lapstun |
| 2001/0027130 | A1 | 10/2001 | Namba et al. |
| 2001/0030978 | A1 | 10/2001 | Holloway et al. |
| 2001/0034262 | A1 | 10/2001 | Banyai |
| 2001/0040345 | A1 | 11/2001 | Au-Yeung |
| 2002/0022511 | A1 | 2/2002 | Eklund et al. |
| 2002/0084335 | A1 | 7/2002 | Ericson |
| 2002/0171201 | A1 | 11/2002 | Au-Yeung |
| 2002/0187825 | A1 | 12/2002 | Tracy et al. |
| 2003/0050109 | A1 | 3/2003 | Caro et al. |
| 2003/0114210 | A1 | 6/2003 | Meyer et al. |
| 2004/0076310 | A1 | 4/2004 | Hersch et al. |
| 2004/0173965 | A1 | 9/2004 | Stanek |
| 2004/0178582 | A1 | 9/2004 | Garrod |
| 2004/0185931 | A1 | 9/2004 | Hartman et al. |
| 2004/0204222 | A1 | 10/2004 | Roberts |
| 2004/0259631 | A1 | 12/2004 | Katz et al. |
| 2004/0266514 | A1 | 12/2004 | Penrice |

FOREIGN PATENT DOCUMENTS

| | | |
|---|---|---|
| AU | B-21070/92 | 7/1993 |
| AU | A-50327/96 | 2/1997 |
| AU | B-52499/96 | 2/1997 |
| AU | 199716432 B2 | 9/1997 |
| AU | A-45403/97 | 4/1998 |
| AU | A-63553/98 | 10/1998 |
| DE | 2938307 C2 | 4/1981 |
| DE | 3035898 A1 | 4/1982 |
| DE | 3035947 A1 | 5/1982 |
| DE | 2938307 C3 | 6/1982 |
| DE | 29803107 U1 | 8/1988 |
| DE | 3822636 A1 | 1/1990 |
| DE | 2938307 C3 | 8/1990 |

| | | | |
|---|---|---|---|
| DE | 3822636 | A1 | 1/1992 |
| DE | 3415114 | A1 | 10/1995 |
| DE | 19646956 | C1 | 5/1998 |
| DE | 19706286 | A1 | 5/1998 |
| DE | 29816453 | U1 | 4/1999 |
| DE | 19751746 | A1 | 5/1999 |
| EP | 0122902 | B1 | 4/1984 |
| EP | 0333934 | A1 | 9/1989 |
| EP | 0458623 | | 11/1991 |
| EP | 0798676 | A1 | 10/1997 |
| EP | 0799649 | A1 | 10/1997 |
| EP | 0149712 | A2 | 7/1998 |
| EP | 0874337 | A1 | 10/1998 |
| EP | 0896304 | A2 | 2/1999 |
| EP | 0914875 | A2 | 5/1999 |
| EP | 0914875 | A3 | 5/1999 |
| EP | 0919965 | A2 | 6/1999 |
| EP | 0983801 | A2 | 3/2000 |
| EP | 0983801 | A3 | 3/2001 |
| EP | 1149712 | A1 | 10/2001 |
| ES | 529535 | | 6/1983 |
| ES | 529536 | | 6/1983 |
| ES | 2006400 | | 4/1989 |
| ES | 2006401 | | 4/1989 |
| GB | 642892 | A | 9/1950 |
| GB | 2075918 | A | 11/1981 |
| GB | 2222712 | B | 3/1990 |
| GB | 2230373 | A | 10/1990 |
| GB | 2295775 | A | 12/1996 |
| GB | 3328311 | | 2/1999 |
| GB | 23282311 | A | 2/1999 |
| JP | 02235744 | | 9/1990 |
| JP | 04132672 | | 5/1992 |
| WO | WO85/02250 | A1 | 5/1985 |
| WO | WO91/17529 | | 11/1991 |
| WO | WO 98/03910 | | 1/1998 |
| WO | WO 98/40138 | | 9/1998 |
| WO | WO 99/09364 | A1 | 2/1999 |
| WO | WO 99/26204 | | 5/1999 |
| WO | WO 99/36312 | | 8/1999 |
| WO | WO00/00256 | | 1/2000 |
| WO | WO00/78418 | A1 | 12/2000 |
| WO | WO01/74460 | A2 | 11/2001 |
| WO | WO01/93966 | A1 | 12/2001 |
| WO | WO02/056266 | A1 | 7/2002 |

OTHER PUBLICATIONS

'Beginner's Guide-How To Bet', (www.plimico.com/How+to+wager/beginnersguide/), (Internet Article), 3 Pgs.

Chip Brown, 'Austin American-Statesman', (Article), May 28, 1998, 2 Pgs., Texas.

John C. Hallyburton, Jr., 'Frequently Asked Questions About Keno', (Internet Article), 1995, 1998, 10 Pgs., (http://conielco.com/faq/keno.html).

'Horse betting Tutorial-Types of Bets' (www.homepokergames.com/horsebettingtutorial.php), (Internet Article), 2 Pgs.

Judith Gaines, 'Pool Party Betting Business Booming Throughout Area Workplaces', (Internet Article), Mar. 19, 1994, 2 Pgs., Issue 07431791, Boston Globe, Boston, MA.

'Maryland Launches Let It Ride', (Internet Article), Circa 2001, 1 Pg.

'Notice of Final Rulemaking', (Internet Article) Mar. 24, 2000, 10 Pgs., vol. 6, Issue #13, Arizona Administrative Register, Arizona.

'How To Play Megabucks', (Internet Article), Mar. 9, 2001, 2 Pgs., Oregon Lottery Megabucks, (http://www.oregonlottery.org/mega/m_howto.htm).

'How To Play Megabucks', (Internet Article), May 8, 2001, 2 Pgs., Oregon Lottery Megabucks, (http://www.oregonlottery.org/mega/m_howto.htm).

'Oregon Lottery', (Internet Article), Apr. 30, 2004, 9 Pgs., Oregon Lottery Web Center, (http://www.oregonlottery.org/general/g_hist.shtml).

'Powerball Odd & Prizes', 'How to Play Powerball', (Internet Article), Dec. 2002, 2 Pgs., (www.powerball.com/pbhowtoplay.shtm).

'Powerball Prizes and Odds's , (Internet Article), 2 Pgs., http://www.powerball.com/pbprizesNOdds.shtm.

'Learn To Play the Races' (Internet Article), 15 Pgs., Racing Daily Form (www.drf.com).

Mike Parker, 'The History of Horse Racing' (Internet Article), 1996, 1997, 1998, 5 Pgs., http://www.mrmike.com/explore/hrhist.htm.

* cited by examiner

1600

| Matches | Prize |
|---|---|
| Raffle # + 3 or more matches | Raffle Prize + Jackpot |
| Raffle # | Raffle Prize |

1700

| Matches | Prize | 1/Probability |
|---|---|---|
| 6 | Jackpot | 12,271,512.0 |
| 5 + Bonus | $5,000 + | 48,696.5 |
| 5 | $5,000 | |
| 4 + Bonus | $100 + | 950.2 |
| 4 | $100 | |
| 3 + Bonus | $5 + | 53.4 |
| 3 | $5 | |
| 2 + Bonus | > $0 | 7.3 |

| Matches | Winners (No Bonus) | Winners (Bonus) |
|---|---|---|
| 6 | 0 | 0 |
| 5 | 1 | 0 |
| 4 | 50 | 20 |
| 3 | 900 | 380 |
| 2 | 9,000 | 3,600 |

FIG. 18

| Matches | Prizes (No Bonus) | Prizes (Bonus) |
|---|---|---|
| 6 | No Winners | No Winners |
| 5 | $5,000 | No Winners |
| 4 | $100 | $426 |
| 3 | $5 | $31 |
| 2 | | $6 |

FIG. 19

$5.00

DIGIT GAME

ELEPHANT

NUMBER: 5 RAFFLE: 958049

| Matches | Prize |
|---|---|
| Raffle Number and Digit | Raffle Prize + Jackpot |
| Raffle Number | Raffle Prize |

FIG. 23

| Matches | Prize |
|---|---|
| Digit and Symbol | $10+ |
| Digit | $10 |

FIG. 24

$5.00

ELEPHANT 17 22 27 41 42
57 60 72 80 91

RAFFLE: 4367652

| Matches | Prize |
|---|---|
| Raffle Number and 2-Digit Number | Raffle Prize + Jackpot |
| Raffle Number | Raffle Prize |

FIG. 26

| Matches | Prize |
|---|---|
| 2-Digit Number and Symbol | $10+ |
| 2-Digit Number | $10 |

FIG. 27

| Matches | Prize |
|---|---|
| 6 | $500,000 |
| 5 | $5,000 |
| 4 | $100 |
| 3 | $7 |

| Match | Prize |
|---|---|
| Raffle Number | Raffle Prize |
| Raffle Number + 6 or More Cumulative Matches | Raffle Prize + Jackpot |

EXTENSION TO A LOTTERY GAME FOR WHICH WINNING INDICIA ARE SET BY SELECTIONS MADE BY WINNERS OF A BASE LOTTERY GAME

RELATED APPLICATION

This application claims the benefit of U.S. Provisional Application No. 60/634,210, Extension To A Lottery Game For Which Winning Indicia Are Set by Selections Made By Winners Of The Base Lottery Game, filed on Dec. 8, 2004, the entirety of which is hereby incorporated herein by this reference.

BACKGROUND OF THE INVENTION

1. Field of the Invention

The invention relates in general to lottery games. More particularly, the invention relates to a lottery game in which winning numbers are determined by an accompanying game.

2. Description of the Related Art

Traditionally a lottery chooses its winner by means that is not affected by action of lottery players. For example, in a raffle game, a winner is chosen by selecting a winning number from a set of numbers, and the selection is not affected by each player's action. Some lotteries have taken a different approach, in which the winning number is indirectly affected by players. An example of this approach is "Darkhorse Wagering" disclosed in U.S. Pat. No. 6,098,797. Darkhorse Wagering permits a player to make selections that affect the outcome of the game, and the least popular player selection is chosen to be the winner. In Darkhorse Wagering the winner is always the least popular player selection, which means that majority of players will not win most of time, and they may lose interest in the game in the long run. Therefore, it is to an extension lottery game in which players who make popular choices may occasionally win that the present invention is primary directed.

SUMMARY OF THE INVENTION

The current invention is an extension to a lottery game. A player participates in an extension game by selecting or having assigned game indicia. Winners are determined for a base game. Thereafter the indicia for the extension game selected by winners of the base game are designated winning indicia for the extension game. Prizes for the extension game are based on matches with these designated winning indicia.

In one embodiment, there is provided a method for playing a lottery game. The method includes the steps of playing a base game and receiving a base game entry, electing to play a second lottery game in addition to the base game and selecting game indicia for said second game, selecting a winning entry for the base game, assigning winning game indicia for the second game to be the game indicia selected for the second game on the winning base game entry, comparing said winning game indicia to the game indicia of additional base game entrants that elected to play the second game so that winners of the second game are determined based on matches with the indicia for the second game on the winning base game entry, and awarding prizes to winners of the base game only, the second game only, and both the base game and the second game.

In another embodiment, there is provided another method for playing a lottery game. The method includes receiving a set of selected digits for an extension game from a player, issuing a game ticket with set of selected digits for a base game to the player, selecting a winning ticket for the base game, determining selected digits associated with the winning ticket, and determining a prize for each game ticket having the selected digits.

In yet another embodiment there is provided a system for playing an extension game to a lottery game. The system includes a plurality of game terminals and a lottery game server. Each terminal is capable of accepting lottery game entries from players and offering a player an opportunity to player the extension game. The lottery game server communicates with the plurality of game terminals, and the lottery game server is capable of receiving a set of selected digits for the extension game from a player, issuing a game ticket with the set of selected digits for the lottery game to the player, selecting a winning ticket for the lottery game, determining selected digits associated with the winning ticket, and determining a prize for each game ticket having the selected digits.

BRIEF DESCRIPTION OF THE DRAWINGS

FIG. 18 illustrates the results of a particular game.

FIG. 19 illustrates the prize table for a particular game.

FIG. 23 illustrates an exemplary prize table.

FIG. 24 illustrates an exemplary prize table.

FIG. 26 illustrates an exemplary prize table

FIG. 27 illustrates an exemplary prize table.

DETAILED DESCRIPTION OF THE INVENTION

The current invention is an extension game to a lottery game. In addition to the requirements for a base game, the player selects indicia for the extension game. The base game is conducted, and winners are determined for the base game. The indicia for the extension game selected by the winners of the base game are designated as winning indicia for the extension game. Winners for the extension game are determined based on matches with these designated winning indicia. Percentages of the prize fund for the lottery game are reserved for the winners of the extension game. The popularity of the player-selected indicia controls the win frequency and magnitude of the extension prize. Popular player indicia tend to win more often as these indicia are more likely to have been chosen by winners of the base game. However, popular indicia tend to pay less as the pari-mutuel prize fund is more diluted. Conversely, less popular indicia tend to win less often but the prizes tend to be of higher magnitude. In this way, players can strategize as to the win frequency and magnitude of the prizes by gauging the popularity of the indicia they select.

The invention provides a method by which a lottery game incorporates a raffle. The player selects indicia for a lottery game and is assigned a raffle number. The raffle is conducted and a raffle winner determined. At least one of the indicia selected by the raffle winner is conferred winning indicia. Other winning indicia may be determined by a random game process. Prizes are based on the outcome of the raffle and/or matches with the winning indicia.

One embodiment is a variation of a digits game. In a digits game a player selects a permutation of digits and a bet type. For example, a "straight" bet means that the player wins a prize if his selection matches the lottery's in exact order. Prizes are either set or pari-mutuel. Each of these methods has disadvantages. If prizes are set, the payout is volatile. For example, a set prize for a straight bet for a 3-digits game is $500, based on an average 50% payout and a $1 wager. However, "triples" such as 7-7-7 are popular selections. If and when such a triple is drawn, the payout may be exceedingly large and difficult for the lottery to absorb. On the other hand, if prizes are pari-mutuel, the lottery avoids volatility, but some players are at a disadvantage. For example, the pari-mutuel prize fund for a straight bet for a 3-digits game may be 50%. Popular selections are at a disadvantage in that the prize fund is diluted by a large number of winners. In general, a player of 7-7-7 would win less than that of a less popular selection. The current invention can be embodied as a numbers game in such a way that the lottery avoids volatility and the payout is the same for all player selections.

Figure 2:
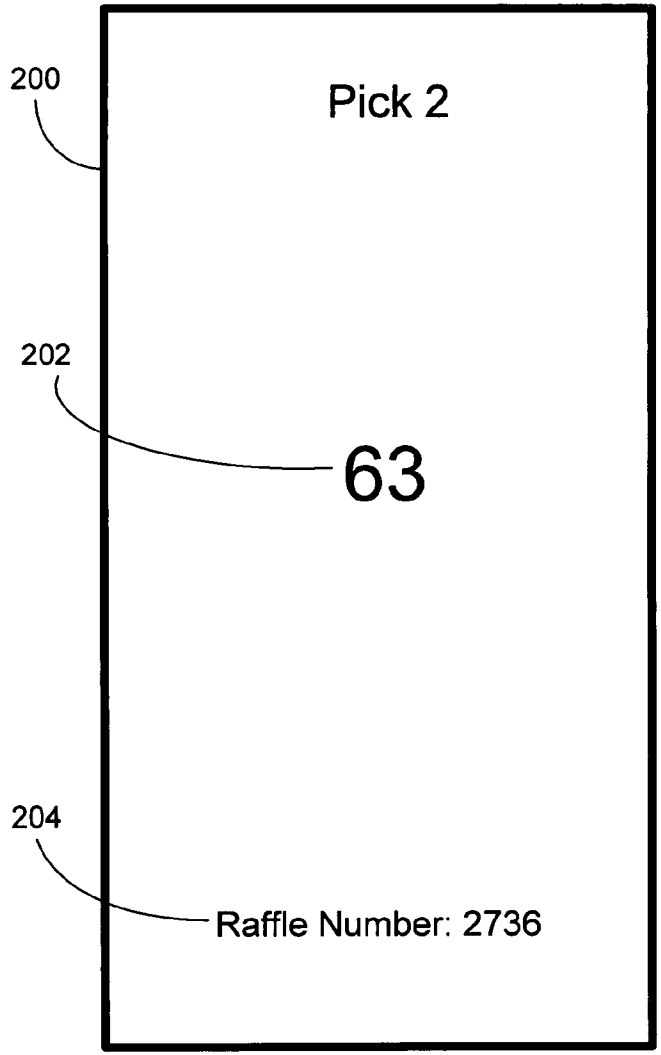
FIG. 2 is an illustration of a ticket displaying the digits selected by a lottery game player with a raffle number thereon.
Figure 1:
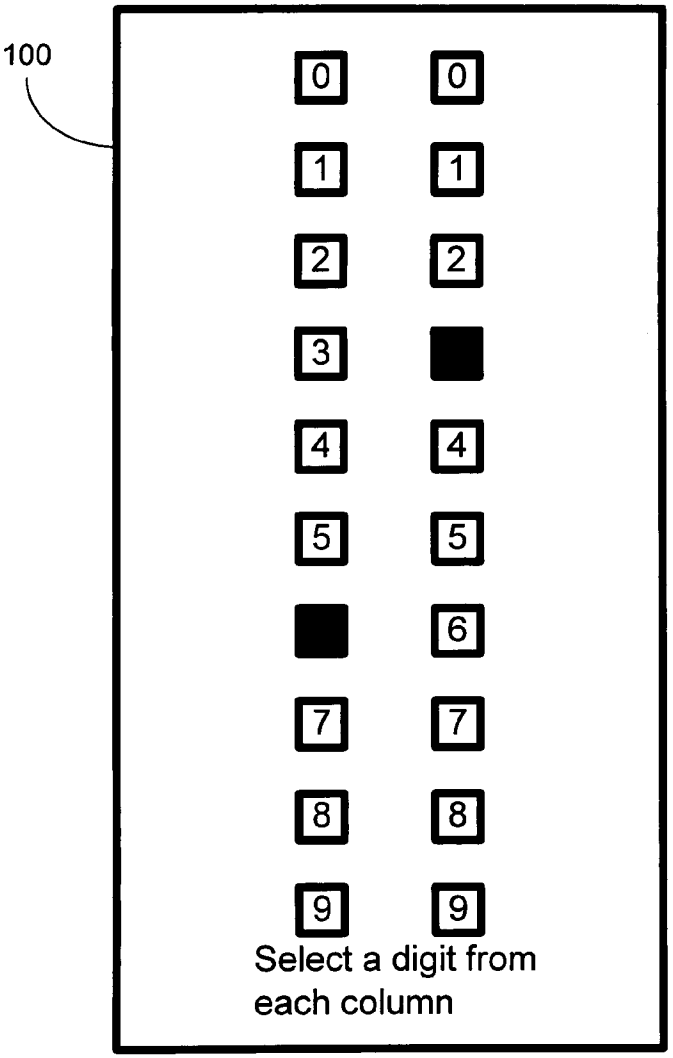
FIG. 1 is an illustration of a playslip for the inventive lottery game.

In another embodiment the base game is a raffle and the extension is a numbers game. The player pays $2 and selects 2 digits from 00 to 99. FIG. 1 illustrates a playslip 100 by which a player makes such a selection. In the example of FIG. 1, the player has selected 63 by darkening boxes corresponding to number 63. The player receives a ticket 200 illustrated in FIG. 2 displaying the digits 202 he selected along with a raffle number 204. The raffle is conducted by a lottery authority and a raffle number is randomly selected. The ticket with the winning raffle number is awarded a portion of the sales, for example 10%. The digits selected by the player with the winning raffle ticket are conferred as the winning digits. Winners of the extension game are those tickets that match these winning digits. These winners equally share another portion of the sales, for example 50%. This game is such that, in the given example, the return is 60% for any player selection. This can easily be proved: For example, Let N be the number of tickets sold, x be a selection of digits, and n be the number of players who selected x. The probability that a selected raffle ticket will have x as the player selection is n/N. If x is the digits selection on the winning raffle ticket, the prize for the digits game is 50%×Sales/Number of Winners=50%2 N/n. Therefore, the return for the digits game is Prize·Probability/Price=50%2 N/n·n/N/$2=50%. As the return for the raffle game is 10%, the return for the raffle and digits game for player selection x is 10%+50%=60%. In short, the win frequency and magnitude of the prizes is determined by the popularity of the player selection, but the return is 60% independent of the player selection. That is, the player may strategize as to whether he would like to win larger prizes, in which case he may attempt to play unpopular digits or he may prefer smaller prizes at a higher win frequency, in which case he would attempt to play more popular numbers. However, in terms of overall return, no set of digits is at an advantage or disadvantage.

Figure 3:
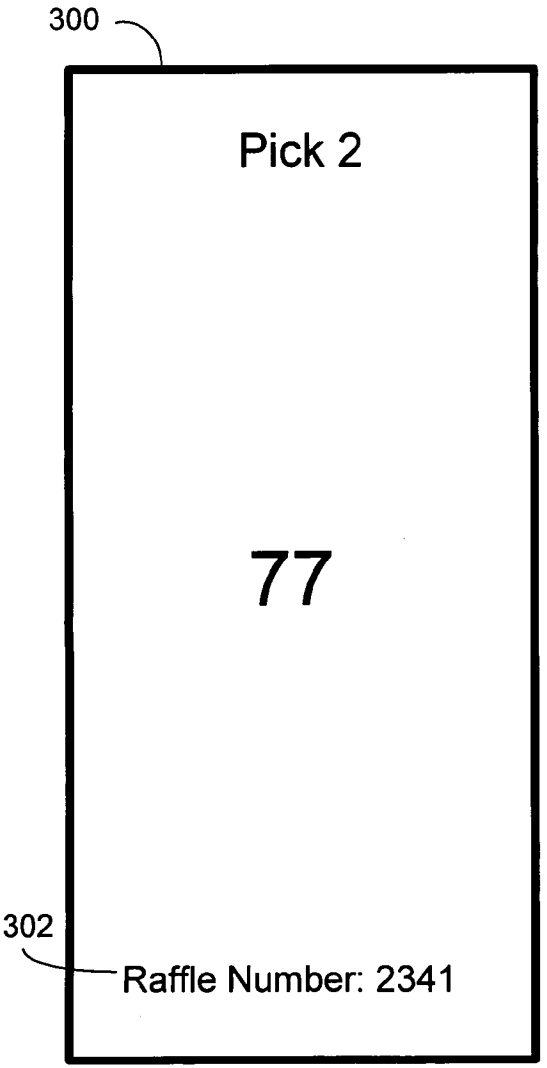
FIG. 3 is an illustration of a ticket that matched the winning raffle number.
Figure 4:
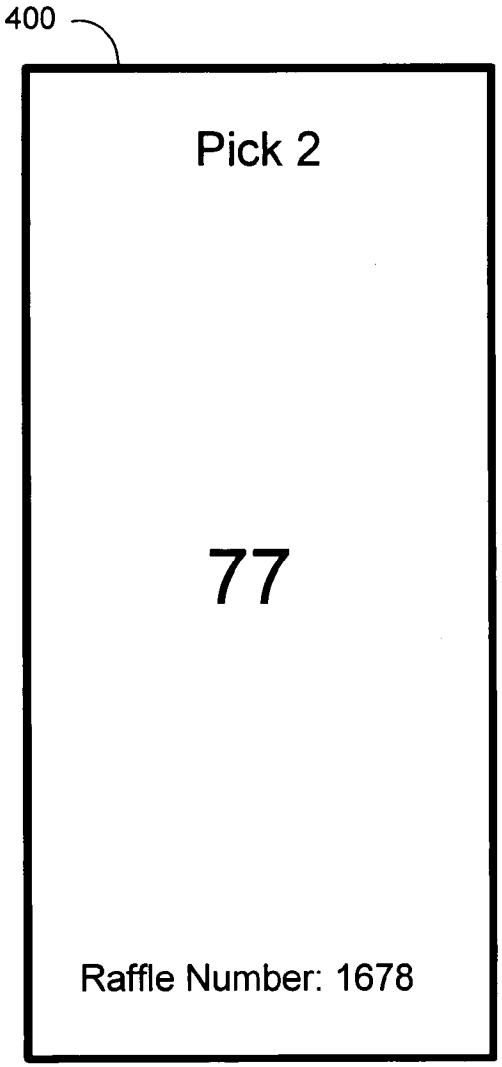
FIG. 4 is an illustration of a ticket that did not match the winning raffle number but did match the winning digits.
Figure 5:
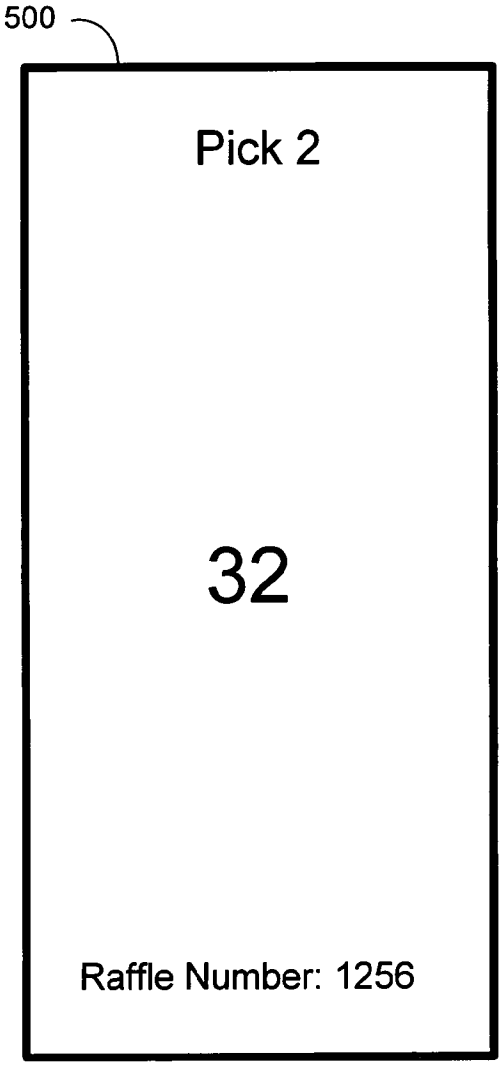
FIG. 5 is an illustration of a ticket that neither matched the winning raffle number nor the digits.

Additional examples of the inventive game of this invention are disclosed below:

Example 1: Sales are $6,000 (3,000 tickets). The raffle is conducted and the winning number is 2341. As 10% of the sales are reserved for the raffle, the raffle prize is $600. FIG. 3 illustrates the ticket 300 with the winning raffle number 302. The chosen digits for this entry are 77. Therefore, 77 is the winning outcome for the digits, or extension, game. Suppose that a total of 150 players chose digits 77. As 50% of the sales is reserved for the digits prize and there are 150 winners, the prize for the digits game is 50%×$6,000/150=$20. FIGS. 3–5 illustrate various tickets. FIG. 3 is the ticket that matched the winning raffle number. As this ticket sets the winning digits, it is automatically a digits game winner. This ticket is awarded the raffle prize plus the digits game prize: $600+$20=$620. FIG. 4 illustrates a ticket 400 that did not match the winning raffle number but did match the winning digits. This entry is awarded $20 for the digits game. FIG. 5 illustrates a ticket 500 that neither matched the winning raffle number nor the digits. This entry does not win a prize.

Figure 6:
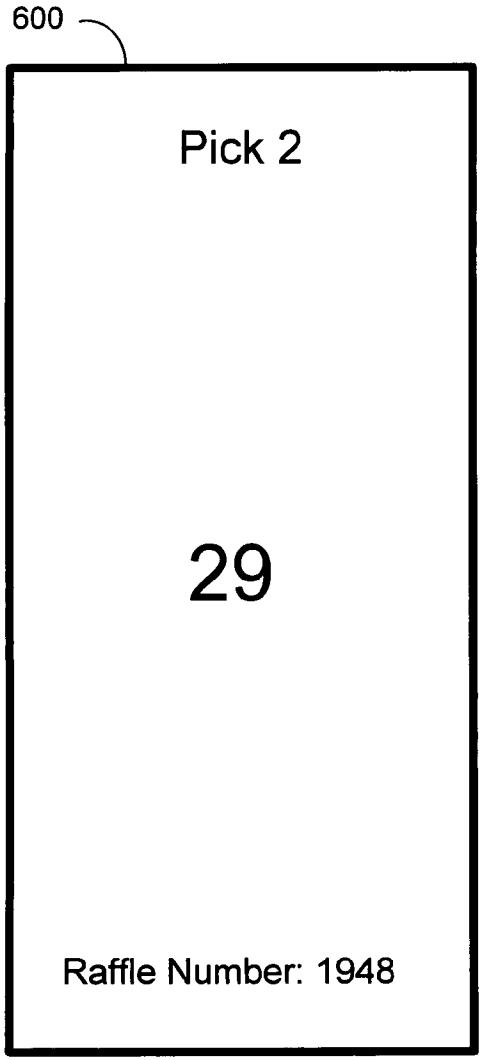
FIG. 6 is an illustration of a ticket with the winning raffle number.
Figure 7:
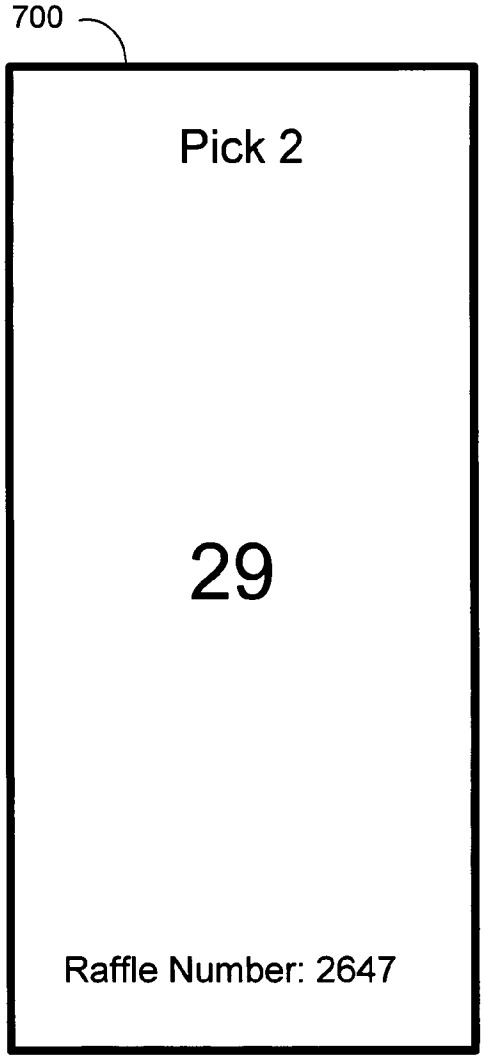
FIG. 7 is an illustration of a ticket that did not match the winning raffle number but did match the sequence of digits.
Figure 8:
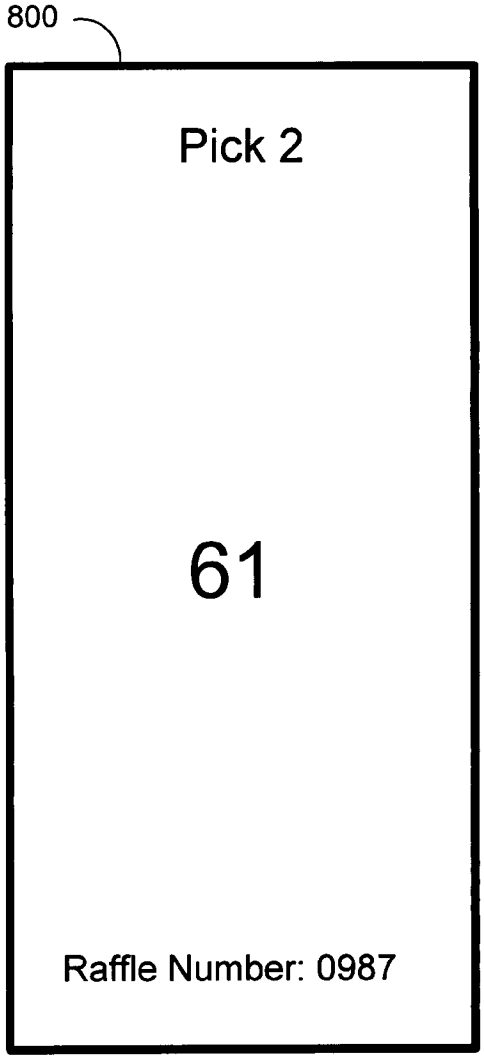
FIG. 8 is an illustration of a ticket that matched neither the winning raffle number nor the winning digits.

Example 2: Sales are $6,000 (3,000). The winning raffle number is 1948 and the chosen digits for the ticket matching the winning raffle number are 29 as illustrated by ticket 600 in FIG. 6. Therefore, the winning digits are 29. Suppose that 15 players chose number 29. The raffle prize is 10%×$6,000=$600, the same as in Example 1. The digits game prize is 50%×$6,000/15=$200. This ticket is awarded the raffle prize plus the digits game prize: $600+$200=$800 FIG. 7 illustrates a ticket 700 that did not match the winning raffle number but did match the sequence of digits. This ticket is awarded $200. FIG. 8 illustrates a ticket 800 that matched neither the winning raffle number nor the winning digits. This ticket does not win any prize. Note that by selecting a less popular number combination for the digits game, the player game winnings are greater per player than with the more popular number combination of Example 1.

In the above examples, the prize for the base game (i.e., the raffle) is a cash prize. However, the game could easily be embodied as to award merchandise, rather than cash, as the raffle prize. For example, 10% of sales could be allotted for a raffle prize fund as illustrated for several examples below.

Figure 9:
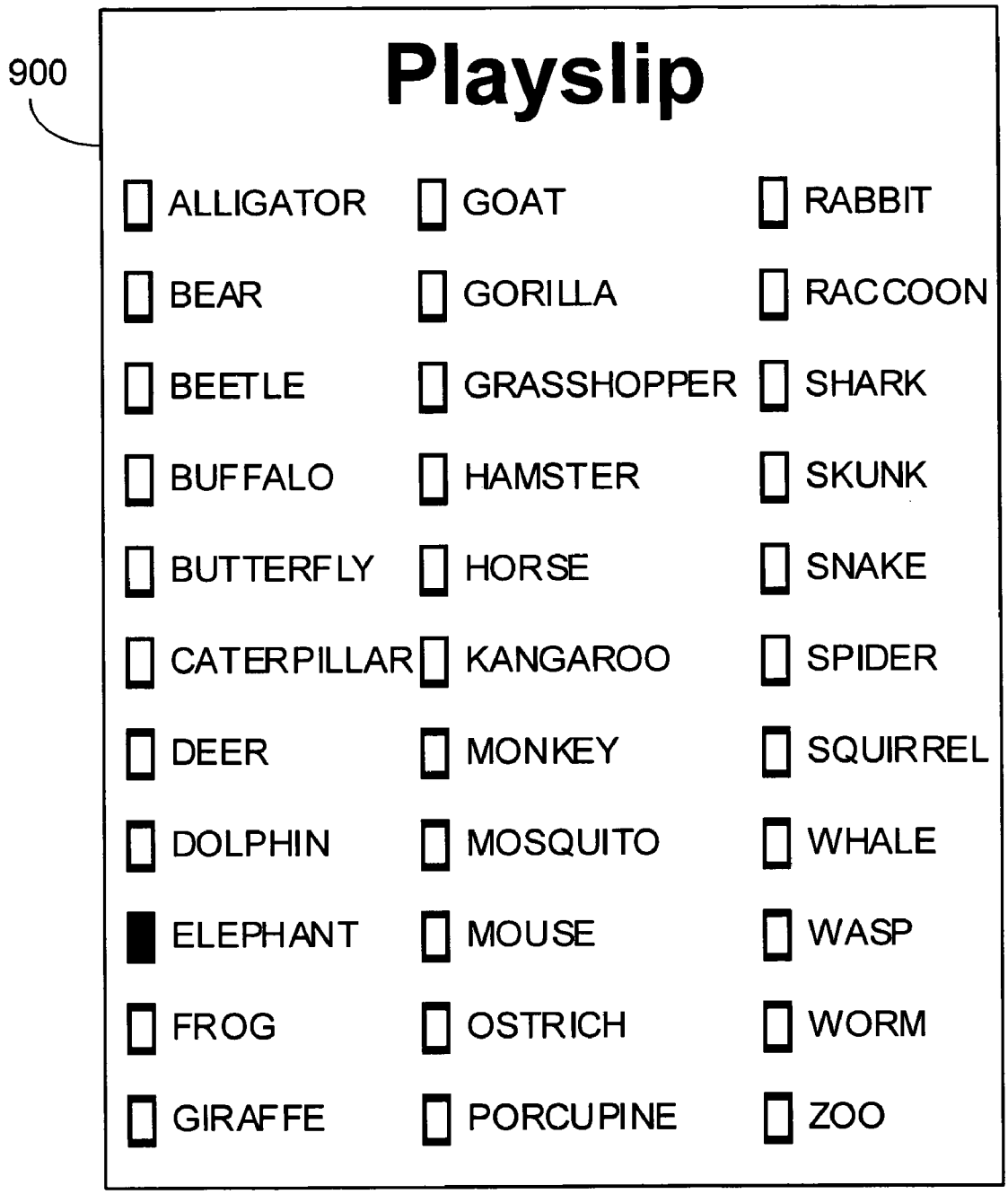
FIG. 9 is an illustration of an exemplary play slip that incorporates a theme.
Figure 10:
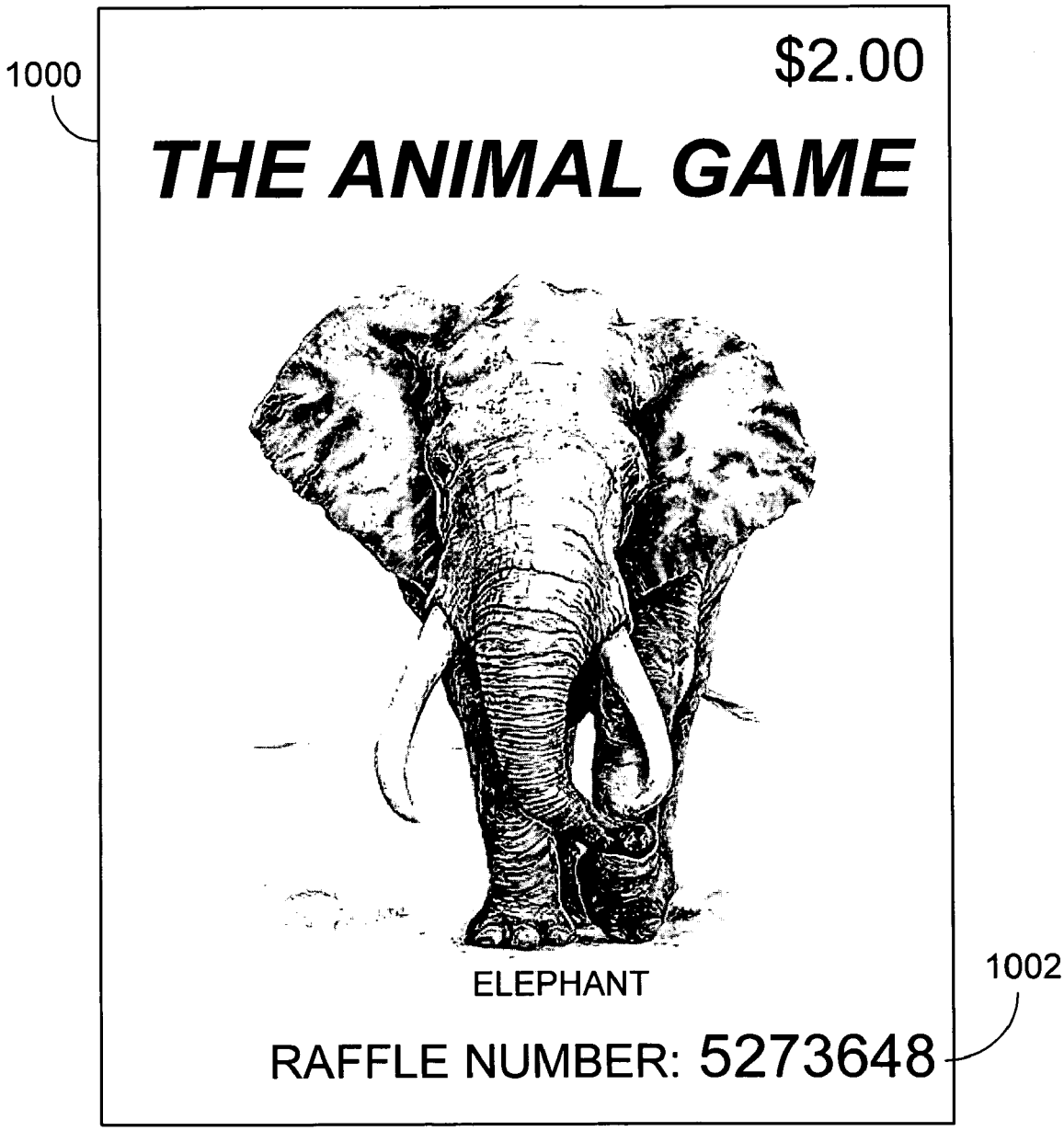
FIG. 10 is an illustration of an exemplary ticket that incorporates a theme.
Figure 12:
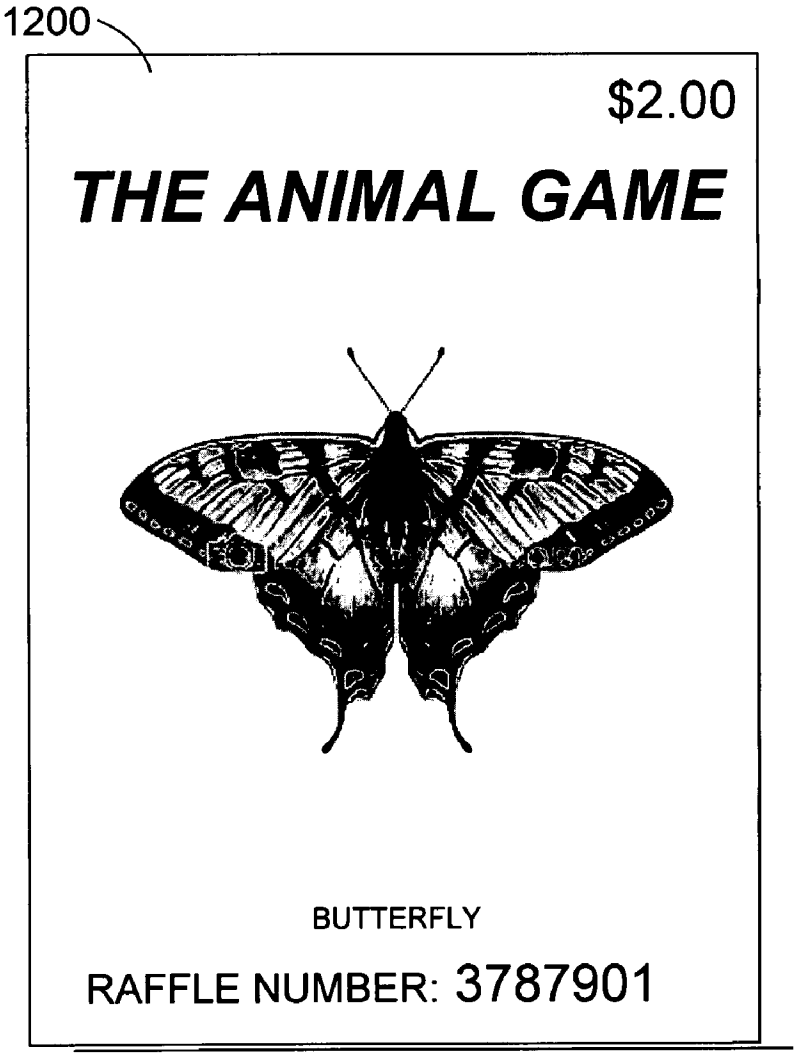
FIG. 12 is an illustration of an exemplary ticket that incorporates a theme.
Figure 11:
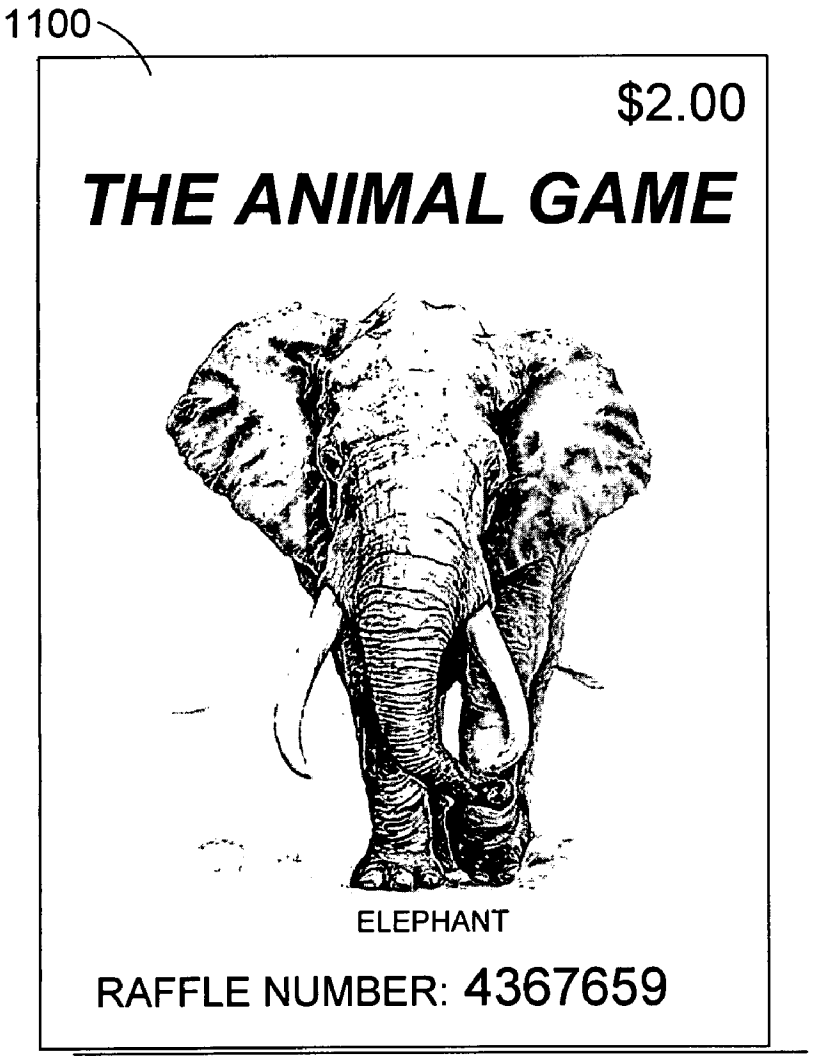
FIG. 11 is an illustration of an exemplary ticket that incorporates a theme.

In Example 3, the invention can be embodied such that the game indicia are symbols. For example, the invention could be embodied based on an animal theme. The player selects an "animal" via a playslip 900 as in FIG. 9, where the player has marked "ELEPHANT." His selection is memorialized on a ticket 1000 as in FIG. 10 with an image labeled "ELEPHANT." He is also assigned a raffle number 5273648. For each game, exactly one raffle number is drawn. The winning symbol is defined to be that which the raffle winner has selected. The winning raffle play wins the raffle prize. The raffle prize is financed by a fund, for example, comprising 10% of the sales. If the sales for a given draw cannot be predicted, it is prudent to purchase the raffle prize from existing funds. Plays that match the winning symbol may, for example, equally divide 50% of the sales. For example, suppose that 5,000 tickets ($10,000 sales at a price of $2 per ticket) are purchased and for 500 of these tickets ELEPHANT was selected as the symbol. Furthermore, suppose that the number 5273648 is drawn, conferring the ticket in FIG. 10 the raffle winner. The raffle winner receives a prize, such as a vacation package. As the symbol accompanying the winning raffle ticket is ELEPHANT, the winning symbol is ELEPHANT. A share would be worth 50%×$10,000/500=$10. For example, the ticket 1000 in FIG. 10 wins the raffle prize for matching the raffle number (5273648) plus a share of the 50% pool ($10) for having an ELEPHANT as his symbol (the raffle winner always has the winning symbol by definition). The ticket 1100 in FIG. 11 does not have the winning raffle number; however, it does have the winning symbol (ELEPHANT). Therefore, it wins a share, $10. The ticket 1200 in FIG. 12 wins nothing as it neither matches the winning raffle number, nor matches the winning symbol.

Figure 13:
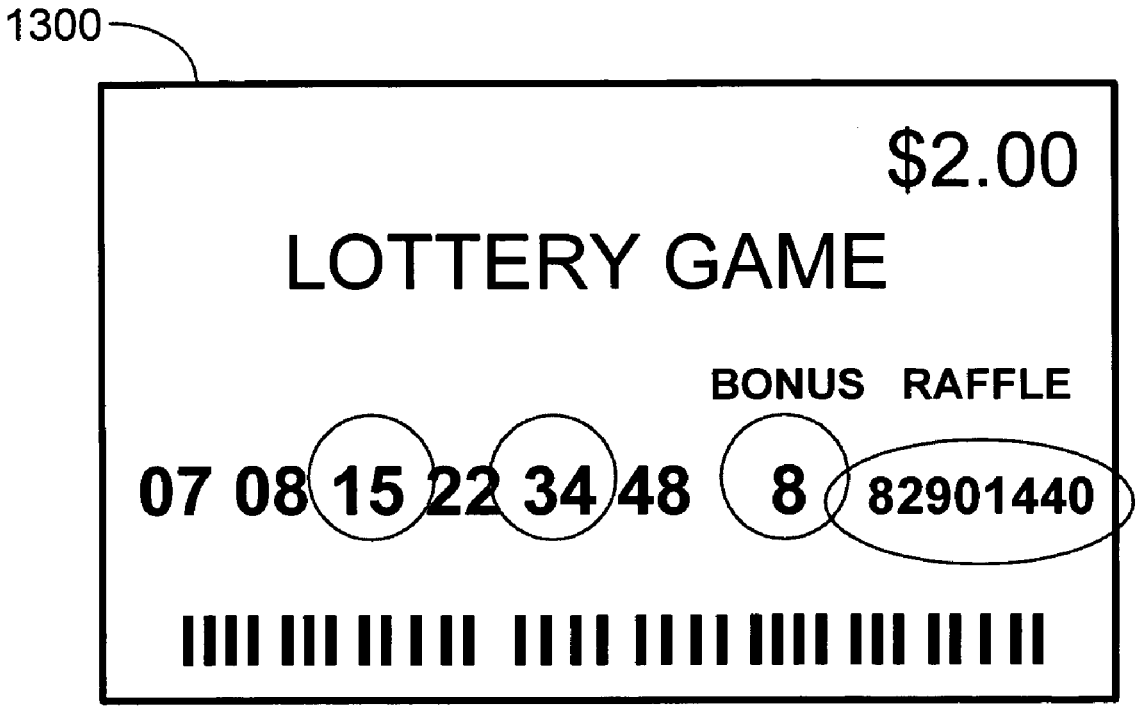
FIG. 13 is an illustration of a lottery game that incorporates the current invention.

In Example 4, the current invention can be combined with a standard lottery game wherein a set of winning numbers is randomly determined by the lottery authority and prizes are based on the number of matches between a play's and the winning numbers. In addition to his play comprising a set of numbers, the player selects a "bonus number" from a field of numbers, for example, from the 10 digits 0 to 9. He is also assigned a raffle number. FIG. 13 illustrates a ticket 1300 for this embodiment: The numbers for the base game selected by the player are 7, 8, 15, 22, 34, 48, and the "bonus number" selected by the player is 8. The lottery assigns to the play a raffle number 82901440. The event of the draw consists of the lottery drawing 6 numbers out of 48 and a raffle number, for which there is exactly one corresponding ticket. The "winning bonus number" is decided by the winning raffle ticket: it is defined to be the bonus number selected (or quick-picked) by the raffle winner.

Figures 15, 16, 17:
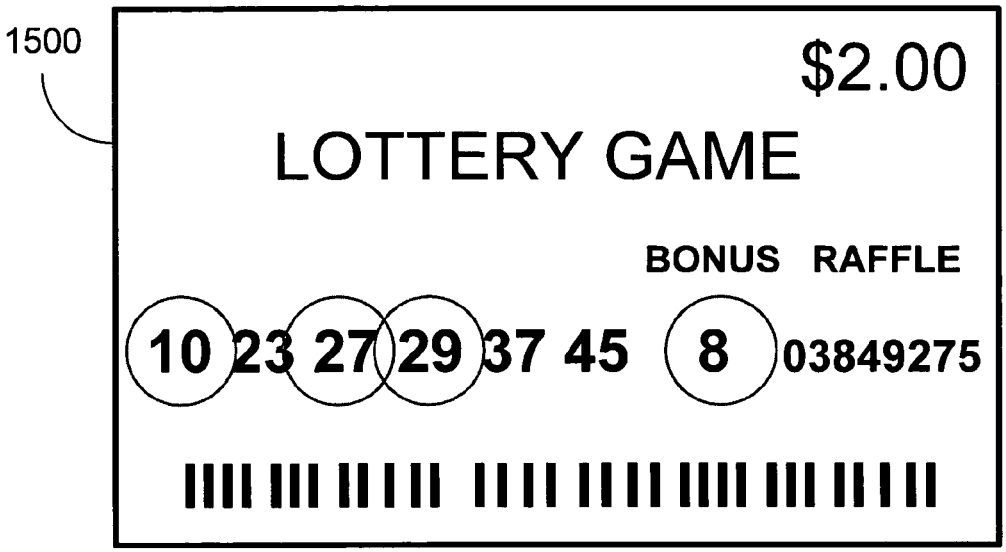
FIG. 15 is an illustration of a lottery game that incorporates the current invention.
FIG. 16 is an illustration of a prize table wherein prizes involve matching a raffle number.
FIG. 17 is an illustration of a prize table that includes prizes based on matching a bonus number.

The prizes for example 4 are determined by two tables illustrated in FIG. 16 and FIG. 17. The play is awarded the sum of the two. The prizes related to the raffle number 1300 are in FIG. 16. For each draw there is exactly one raffle winner. The raffle prize is awarded to the play with the drawn raffle number. The raffle prize may be merchandise (e.g., a motor vehicle) or cash. The raffle prizes may be funded, for example, by 5% sales and may vary in magnitude, depending on available funds. There is also a Jackpot prize. In this example, it is pari-mutuel and progressive. As indicated in FIG. 16, if the play matches the raffle number and 3 or more matches in the base game (i.e., the standard 6 out of 48 matrix game), it is awarded the raffle prize and the Jackpot.

The prize table 1700 in FIG. 17 illustrates an example of prizes based on the number of matches in the base game and whether or not the player matches the bonus number. The prize for matching all 6 numbers is the Jackpot. This is the same Jackpot as that for the prize table 1600 in FIG. 16. That is, there are two ways of winning the Jackpot, by matching the raffle number and 3 or more matches in the base game (in which case, the play would also win the raffle prize), or by matching 6 in the base game. The magnitude, funding and management of the Jackpot are flexible. For purposes of this example, it is funded by 23% of the sales, with the Jackpot starting at $500,000 and incrementing a minimum of $100,000 each draw. Such a Jackpot scheme would require a minimum level of sales. For example, $600,000 per draw would be sufficient.

Following the Jackpot prize for matching 6 numbers, prizes for various matches in the base game with and without the bonus number are illustrated in FIG. 17. The prizes for matches in the base game without matching the bonus number are set ($5,000, $100, and $5, for matching 5, 4, and 3 respectively). The "bonus number prizes" for matches in the base game and matching the bonus number are indicated with a "+," meaning the indicated prize is more than that for matching without the bonus number. The exact bonus number prizes will vary from game to game, depending on factors such as sales and the number of winners in each category. There is also a "bonus number prize" for matching 2 in the base game and the bonus prize, whereas there is no prize for matching 2 in the base game and not matching the bonus number. It will be described below a method for assigning prizes for the bonus number.

First, a set percentage of the sales is allocated exclusively for "bonus number prizes," i.e. prizes added to base game prizes for also matching the bonus number. In this exemplary embodiment, 19% of sales is set aside for these prizes. The 19% is subdivided into 4 allocations corresponding to matching 5, 4, 3, or 2 in the base game and matching the bonus number: 1% for matching 5, 2% for matching 4, 4% for matching 3 and 12% for matching 2. Furthermore, if there are no bonus number winners corresponding to one of theses allocations, then that percentage is rolled down to the next level. For example, if there are no plays that both matched 5 in the base game and matched the bonus number, then the 1% allocated for that level is rolled down to the matching 4 level. The percentage for matching 4 in the base game and the bonus number would then be 2%+1%=3%.

Shares are computed for each level (i.e., matching 5, 4, 3, or 2 in the base game) and a play is awarded a share for the highest level for which he qualifies and each lower level. A Type 5 share is computed by dividing the percentage corresponding to matching 5 by the number of winners that both matched 5 in the base game and matched the bonus number. A Type 4 share is computed by dividing the percentage corresponding to matching 4 by the number of winners that both matched 4 or 5 in the base game and matched the bonus number. A Type 3 share is computed by dividing the percentage corresponding to matching 3 by the number of plays that both matched 3, 4 or 5 in the base game and matched the bonus number. A Type 2 share is computed by dividing the percentage corresponding to matching 2 by the number of plays that both matched 2, 3, 4, or 5 in the base game and matched the bonus number.

A play that matches 2 in the base game and matches the bonus number is awarded a Type 2 share. A play that matches 3 in the base game and matches the bonus number is awarded a Type 2 share plus a Type 3 share. A play that matches 4 in the base game and matches the bonus number is awarded a Type 2 share plus a Type 3 share plus a Type 4 share. A play that matches 5 in the base game and matches the bonus number is awarded a Type 2 share plus a Type 3 share plus a Type 4 share plus a Type 5 share. Note that this way of awarding multiple shares ensures that plays at higher levels win higher prizes. For example, a play that matches 5 in the base game and matches the bonus number would necessarily have at least as high a prize as a play that matched 4 in the base game and matched the bonus number.

To illustrate this method of assigning "bonus number prizes," suppose that sales for a particular draw of this game are $200,000 (100,000 plays) and suppose that 30,000 plays have 7 selected as the bonus number. Furthermore, suppose that the raffle winner selected 7 as the bonus number. This sets the winning bonus number as 7. Suppose the results of the game are as those illustrated in FIG. 18. For example, the number of winners that matched 4 and did not match the bonus number is 50. The number of winners that matched 4 and matched the bonus number is 20. A total of 19% is allocated for prizes matching the bonus number. The 19% is partitioned into 1%, 2%, 4%, and 12% corresponding to matching 5, 4, 3, and 2 in the base game. It is observed that there are no winners in the matching 5 and the bonus number category. Therefore, the 1% for matching 5 and the bonus number is rolled to the level for matching 4, so that the percentage corresponding to matching 4 is 1%+2%=3%. In other words, in light of the fact that there are winners matching the bonus number at the matching 5 level, the partitioning of 19% is revised: 3%, 4%, and 12% corresponding to matching 4, 3, or 2 in the base game. Shares corresponding to each category are now determined. A Type 2 share is computed by dividing 12% of sales by the number of plays that both match 2, 3, 4 or 5 in the base game and match the bonus number: 12%×$200,000/(3,600+380+20)=$6. Type 3 share is 4%×$200,000/(380+20)=$20. And a Type 4 is 3%×$200,000/20=$300. The bonus number prizes are determined by adding these amounts to $5,000, $100, $5 or $0 corresponding to matching 5, 4, 3, or 2 in the base game. Prizes are summarized in FIG. 19. For example, a player matching 4 and not matching the bonus number is awarded a set $100. A player match 4 and the bonus number wins $100 plus a Type 4 share plus a Type 3 share plus a Type 2 share=$100+$300+$20+$6=$426.

Figure 14:
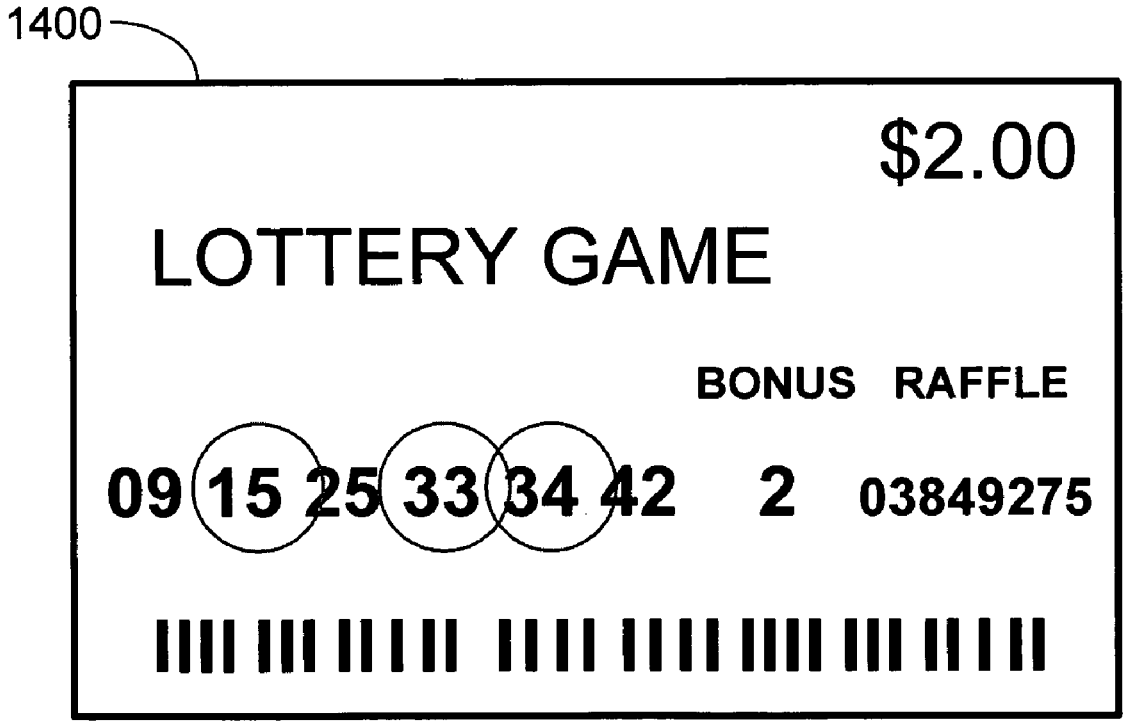
FIG. 14 is an illustration of a lottery game that incorporates the current invention.

For example, if the drawn numbers are 10, 15, 27, 29, 33, 34 and the drawn raffle number is 82901440, then the ticket 1300 in FIG. 13 is the raffle winner. This play wins the raffle prize. Also, it sets the winning bonus digit as 8. Also, it wins $6 for matching 2 and the bonus digit as indicated in FIG. 19. The ticket 1400 in FIG. 14 matches 3 but does not match the bonus number. It wins $5 as indicated in FIG. 19. The ticket 1500 in FIG. 15 wins $31 for matching 3 in the base game and matching the bonus number.

Those skilled in the art of Mathematics can verify that the return for this game is 23.0% (Jackpot)+5.0% (raffle prize)+15.1% (base game prizes for matching 3, 4, or 5)+19.0% (added to base game prizes for bonus number prizes)=62.1%.

Figure 21:
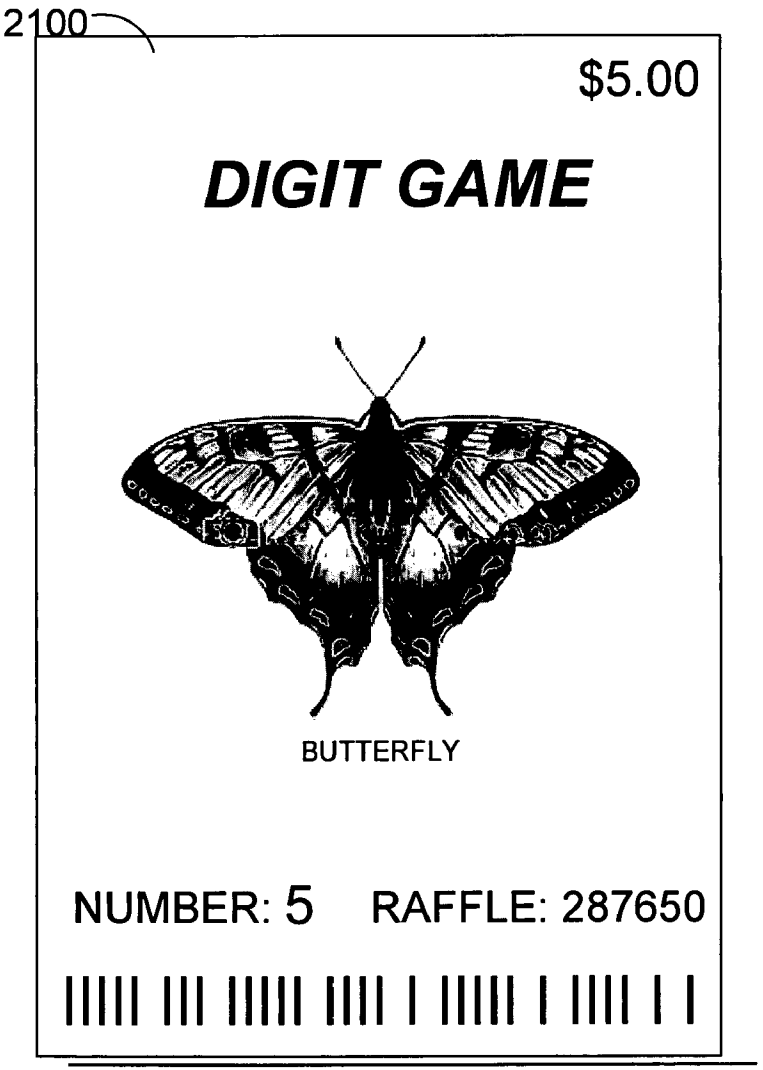
FIG. 21 illustrates an exemplary ticket.
Figure 20:
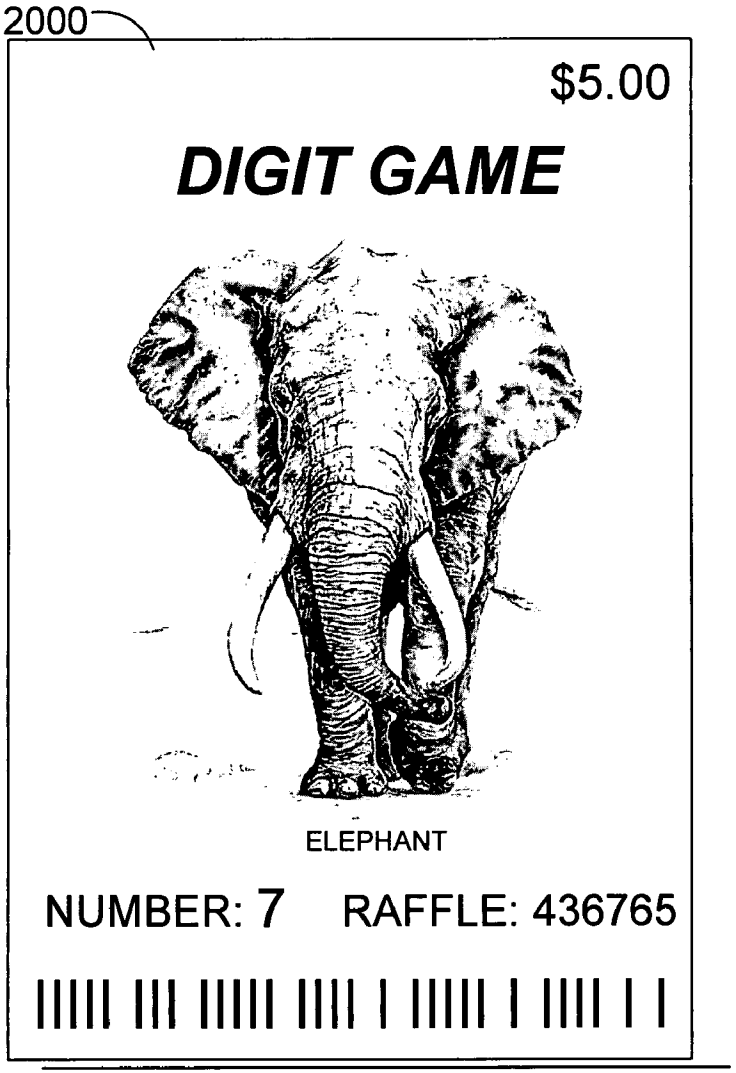
FIG. 20 illustrates an exemplary ticket.
Figure 22:
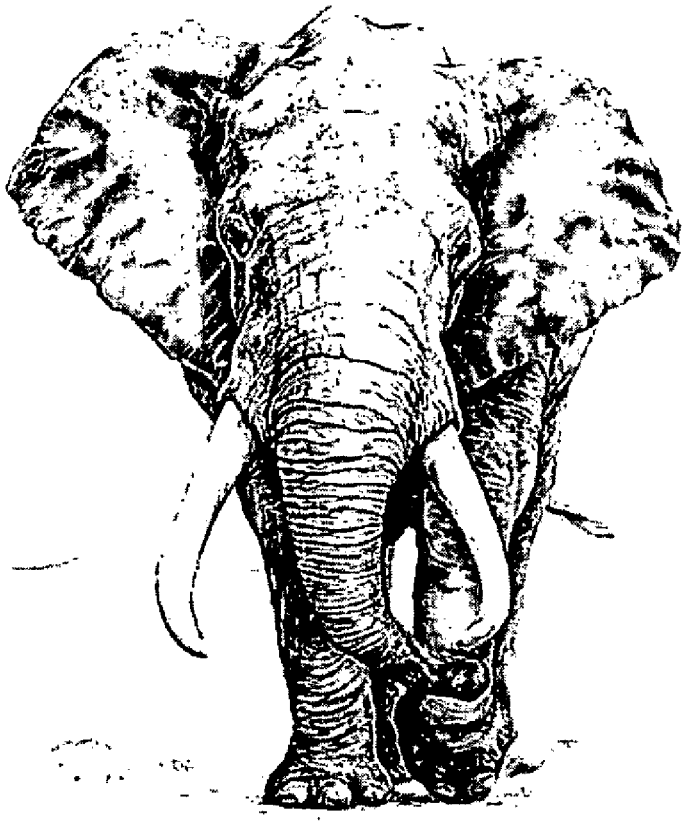
FIG. 22 illustrates an exemplary ticket

In Example 5, another embodiment presents a play with 3 components: a digit from 0 to 9, a symbol selected from a set (in this case, based on an animal theme), and a raffle number. In this example, each play costs $5. The player may choose the number and/or the symbol, and the ticket is assigned a raffle number. An exemplary ticket 2000 is in FIG. 20. The player has selected the digit 7, the symbol ELEPHANT and the ticket is assigned the raffle number 436765. The draw consists of the lottery authority randomly choosing exactly one of the raffle numbers and randomly drawing a number between 0 to 9. The winning symbol is defined to be that selected by the raffle winner. For example, if the raffle number is 436765, the winning symbol is ELEPHANT as that is symbol accompanying the winning raffle number (FIG. 20). The prize tables are illustrated in FIG. 23 and FIG. 24. The play is awarded the sum of the 2 prizes. The prize table in FIG. 23 pertains to the raffle component. A play is awarded the raffle prize if it matches the raffle number. The raffle prize is paid for by a fund that comprises 10% of sales. If the play matches the raffle number and matches the digit, it wins the raffle prize and the Jackpot. The Jackpot is funded by 10% of sales and is progressive and pari-mutuel. More prizes are indicated in FIG. 24. If a play matches the winning digit but does not match the winning symbol it is awarded $10. If the play matches the winning digit and matches the winning symbol the play wins more than $10. The exact amount is computed as follows. First observe that awarding $10 to prizes that match the winning digit comprises a 20% payout (1/10×$10/$5=20%). An additional 20% of the sales is divided equally among plays that both match the winning digit and the symbol. For example, suppose sales are $500,000 (100,000 plays) of which 10,000 plays have the number 5 selected. Of those 10,000, suppose 500 have ELEPHANT as the selected symbol. Suppose that the winning raffle number is 436765. This means that the winning ticket is that in FIG. 20. Since ELEPHANT is the accompanying symbol, ELEPHANT is conferred as the winning symbol. Also, suppose that the winning digit is 5 (randomly drawn by the lottery). A play that matches both the 5 and ELEPHANT it is awarded $10+20%×$500,000/500=$210. For example, the ticket in FIG. 20 would win the raffle prize for matching the raffle number. However, the play does not win any other prizes as it does not match the winning digit. The ticket 2100 in FIG. 21 does not match the raffle number nor the winning symbol, but does match the winning digit. It is awarded $10. The ticket 2200 in FIG. 22 does not match the winning raffle number, but does match the winning digit and the winning symbol. It is awarded $210. The payout for this game is 10% for the raffle prize plus 10% for the Jackpot plus 20% (matching winning digit) plus 20% (matching the winning digit and the winning symbol) for a total of 60%.

Figure 25:
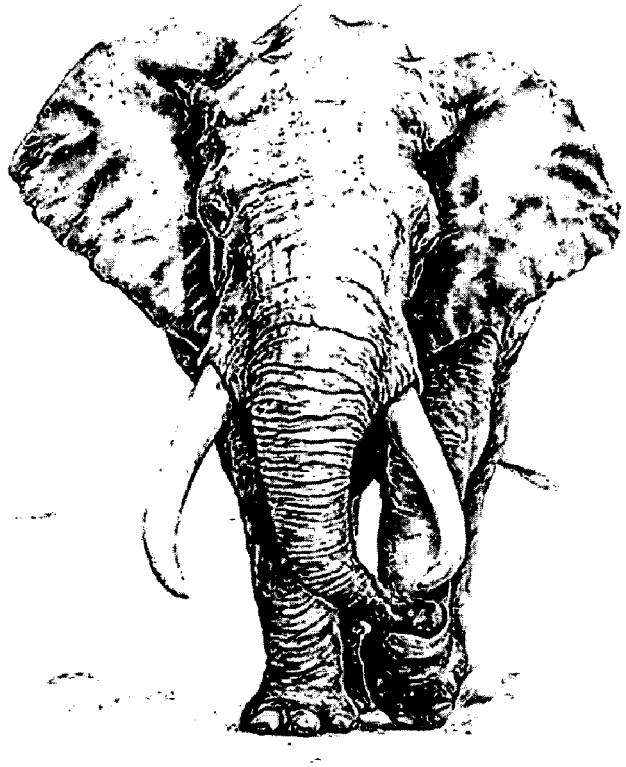
FIG. 25 illustrates an exemplary ticket.
Figure 29:
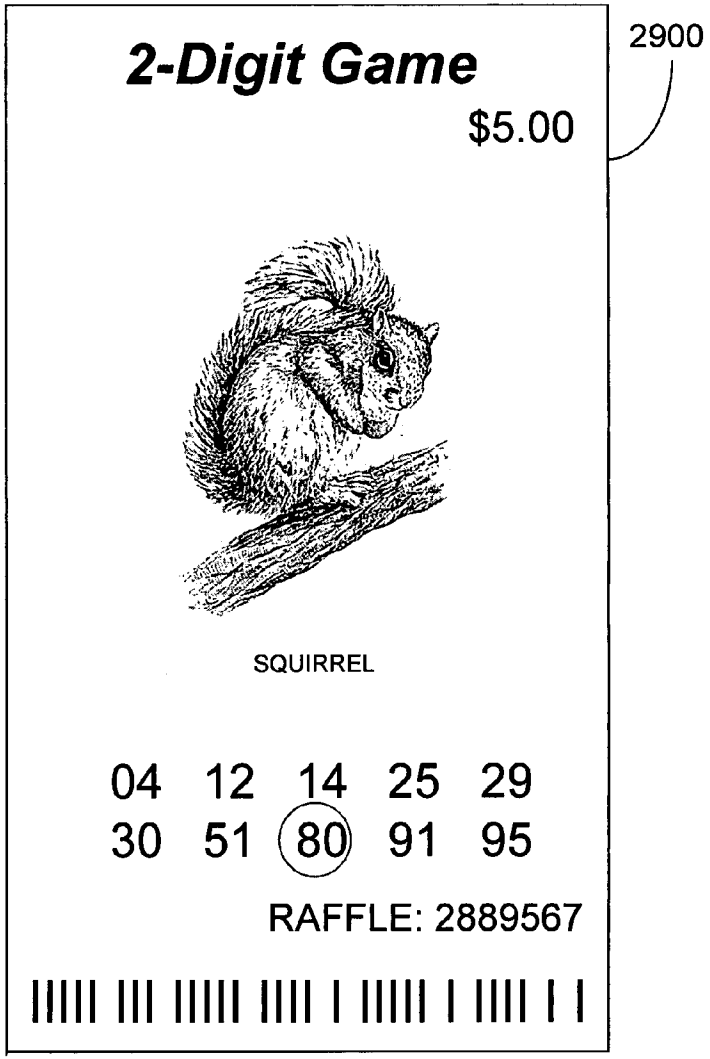
FIG. 29 illustrates an exemplary ticket.
Figure 28:
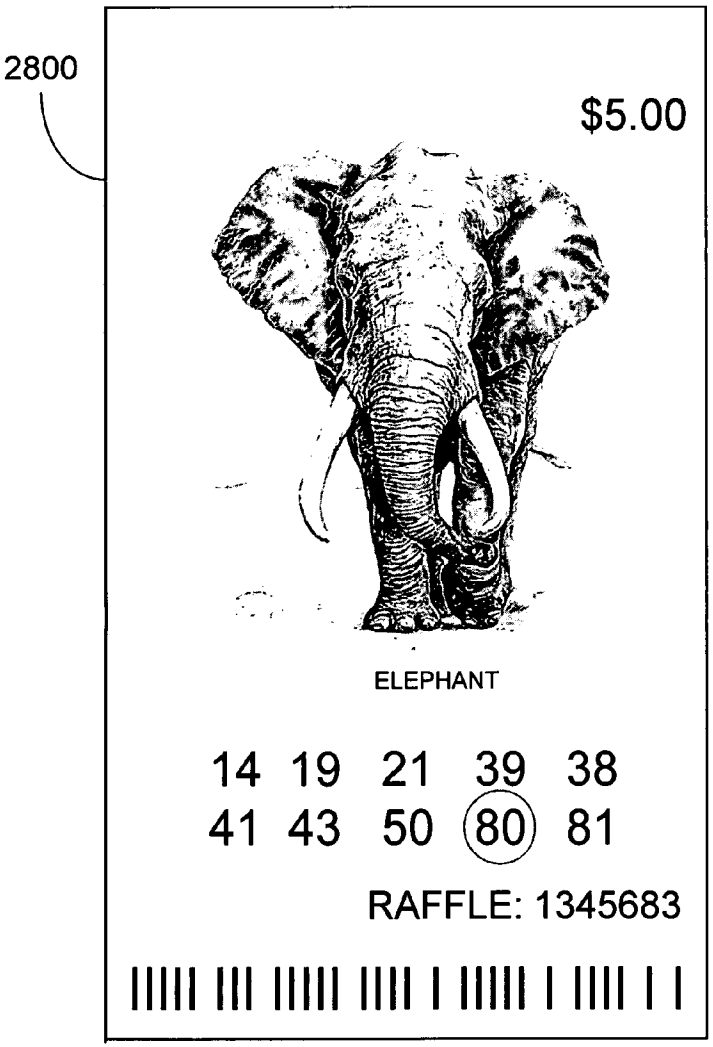
FIG. 28 illustrates an exemplary ticket.

In Example 6, an alternative embodiment is similar to that of Example 5. This embodiment presents a play with 3 components: a symbol selected by the player from a set of symbols, a set of 10 2-digit numbers assigned by the lottery, and a raffle number assigned by the lottery authority. Again in this example, the ticket price is set to $5. An exemplary ticket 2500 is in FIG. 25. For each game, a 2-digit number and a raffle number are randomly drawn by the lottery. The winning symbol is defined to be the symbol accompanies the winning raffle number. For example, if 4367652 is drawn as the raffle number, then that would confer the ticket 2500 in FIG. 25 as the winning raffle ticket. The winning symbol would be ELEPHANT as that is the symbol selected by the raffle winner. Prize tables are illustrates in FIG. 26 and FIG. 27. As indicated in FIG. 26, the ticket that matches the winning raffle number wins the raffle prize (funded by 5% of sales). If the raffle winner also matches one of his 10 2-digit number to the drawn 2-digit number, he also wins the Jackpot (funded by 10% of the sales). Additional prizes are indicated in FIG. 27. A prize of $10 is awarded for matching one the play's 10 2-digit numbers to the winning 2-digit number and not matching the winning symbol. A prize of more than $10 is awarded for matching one of the play's 10 2-digit number to the winning 2-digit number and matching the winning symbol. This additional amount is determined by dividing 20% of sales by the number of plays that matched the winning 2-digit number and the winning symbol. The payout for this game is 5% (raffle prize)+10% (Jackpot)+20% (matching the winning digit)+20% (matching the winning digit plus the winning symbol)=55%. For example, if winning raffle number 4367652, and the winning 2-digit number is 80, then the ticket 2500 in FIG. 25 wins the raffle prize and the Jackpot, as indicated by the prize table in FIG. 26. Plus, ELEPHANT is conferred the winning symbol as that is the symbol that accompanies the winning raffle ticket. Suppose that sales are $100,000 and there are 5,000 plays for which the symbol is ELEPHANT. The ticket 2800 in FIG. 28 matches the winning 2-digit number and the winning symbol. By the prize table in FIG. 27, it wins $10+20%*$100,000/5,000=$14. The ticket 2900 in FIG. 29 matches the winning 2-digit number but does not match the winning symbol. By the prize table in FIG. 27, it wins $10.

Figures 30, 31, 32:
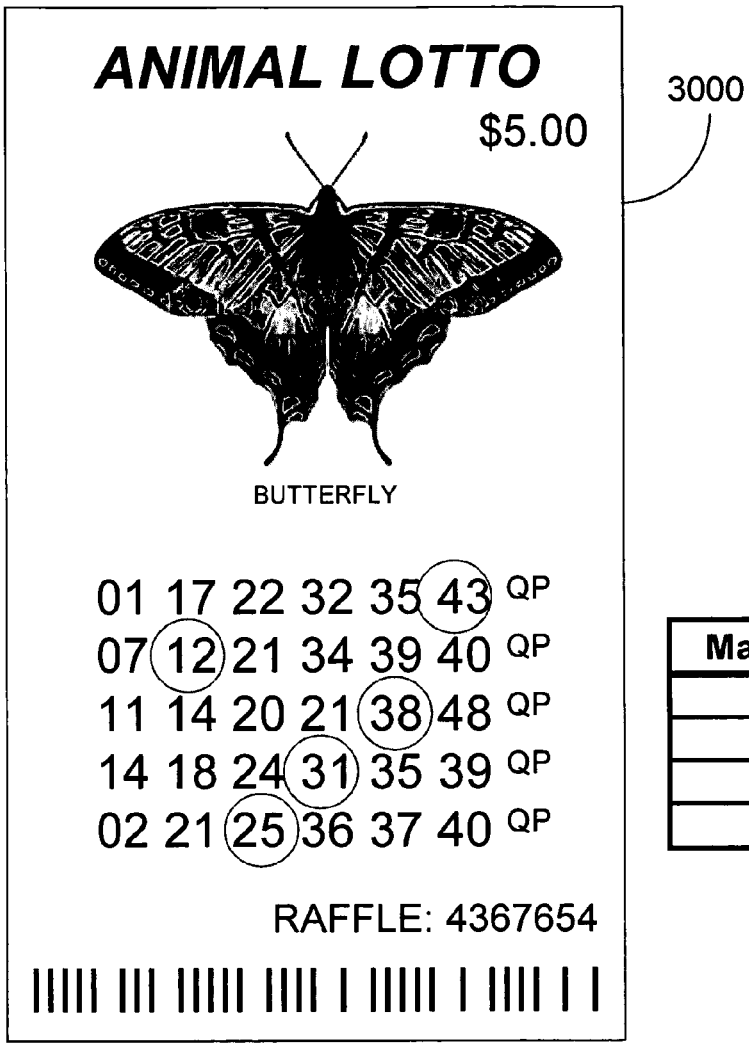
FIG. 30 illustrates and exemplary ticket.
FIG. 31 illustrates an exemplary prize table
FIG. 32 illustrates an exemplary prize table.
Figure 34:
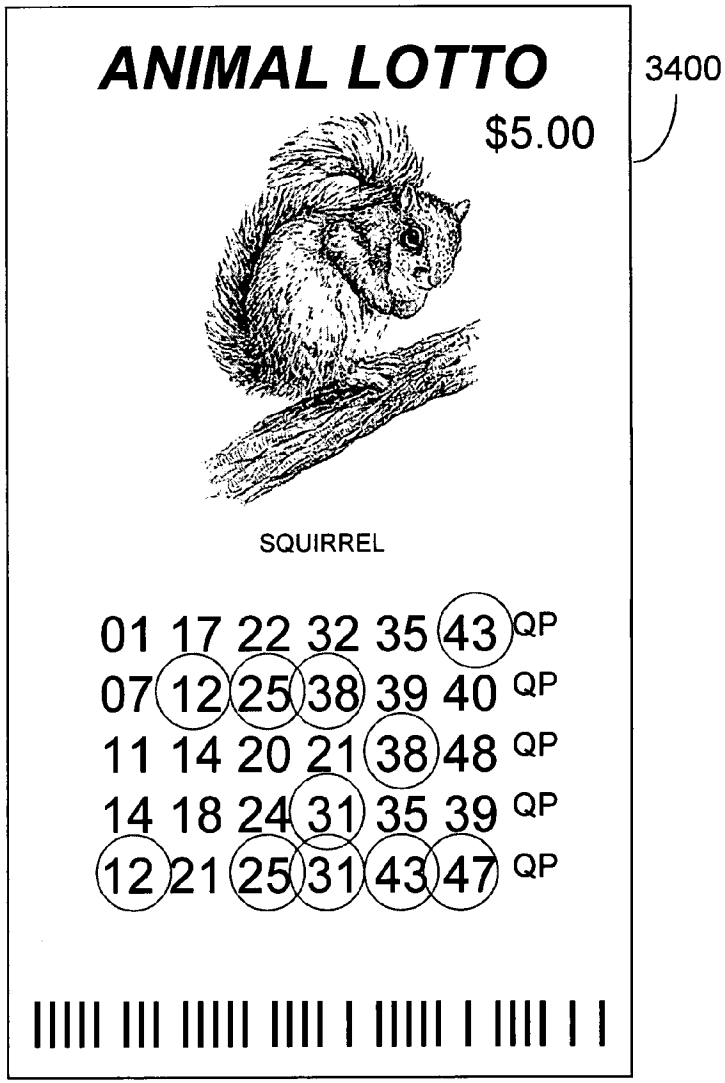
FIG. 34 illustrates an exemplary ticket.
Figure 33:
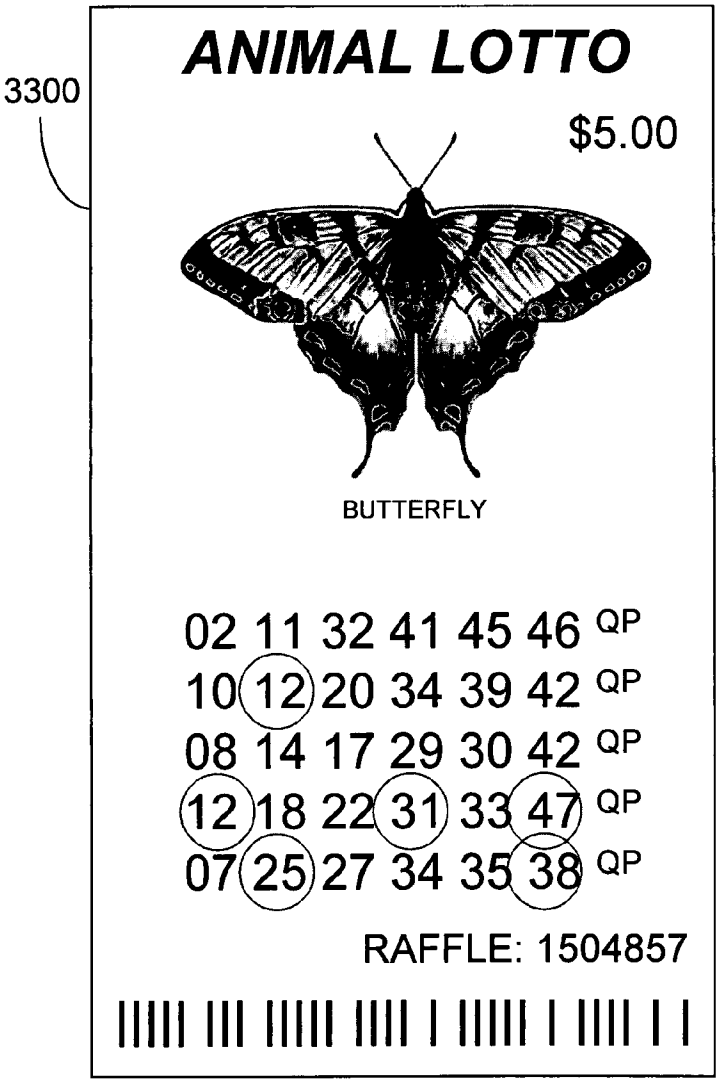
FIG. 33 illustrates an exemplary ticket.

In Example 7, an embodiment of the current invention is combined with a standard lottery game. The price is $5 and an exemplary ticket 3000 is shown in FIG. 30. The "base game" involves, for example, the lottery authority drawing 6 numbers out of 48 and the player matching numbers in his play to the drawn numbers. There are 5 lines for the "base game" on the ticket. A player wins prizes per line and is awarded the sum of these prizes. The prizes for the base game are illustrated in FIG. 31. There is an additional prize table in FIG. 32 based on cumulative matches and the raffle number. If the play matches the winning raffle number, then the play wins the raffle prize (5% sales). Also, the symbol accompanying the winning raffle number is conferred as the winning symbol. If the play matches the winning raffle number and attains 6 or more cumulative matches (i.e. the total attained by adding the number of matches for the 5 individual lines), then the play wins the raffle prize and the Jackpot (funded by 10% sales). If the play matches the winning symbol and attains 6 or more cumulative matches, the play wins a share of 10% of the sales divided equally by the number of such winners. For example, suppose that the drawn numbers are 12, 25, 31, 38, 43, and 47 and that the winning raffle number is 4367654. The ticket with the winning raffle number is illustrated in FIG. 30. This play wins the raffle prize. Also, as the accompanying symbol is BUTTERFLY, BUTTERFLY is conferred the winning symbol. However, this ticket has only 5 cumulative matches and as such does not win the Jackpot. The ticket 3300 in FIG. 33 wins $7 for matching 3 on the $4^{th}$ line, but does not win the Raffle prize or the Jackpot as it does not match the raffle number. Also, it wins a share of the said $10 of the sales as it matches the winning symbol (BUTTERFLY) and at least 6 cumulative matches. The ticket 3400 in FIG. 34 wins $7 for matching 3 on the $2^{nd}$ line and $5,000 for matching 5 on the $5^{th}$ line for a total of $5,007, but does not win the Raffle prize or the Jackpot as it does not match the raffle number. Nor does it win a share of the said 10% as it does not match the winning symbol. Those skilled in the art of Mathematics can verify that the return for this game is 38.0% (base game)+5% (raffle prize)+10% (Jackpot)+10% (matching symbol+6 or more cumulative matches)=63%.

Unlike Darkhorse Wagering disclosed in U.S. Pat. No. 6,098,797, in the current invention, the outcome is not determined explicitly by the popularity of a selection, but rather by an outside mechanism: the outcome of another game. That is, in Darkhorse Wagering, based only on the player selections, a winner is determined: the least popular selection. In the current invention, based on the player selections, probabilities can be assigned to outcomes, but the winner is not determined. It is still possible for any selection to win.

Another difference from Darkhorse Wagering is that in the current invention the return to the player is independent of the popularity of a selection. The more popular a selection, the greater probability of winning, but the less the magnitude of the prize. In terms of the return to the player, there is no advantage or disadvantage based on the popularity of a selection. Some players may prefer to play popular numbers with a greater probability of winning, and some players may prefer to play unpopular numbers for larger prizes, and so on. In contrast, in Darkhorse Wagering, it is always to the player's advantage to try to make an unpopular selection.

The fact that the return is independent of the popularity of a selection is an advantage of this invention over Darkhorse Wagering in that the current invention does not involve skill. The lottery may prefer, or it may be a matter of law, that a lottery game does not involve skill. In Darkhorse Wagering, if information about players' selections is available, for the current game or in the form of historical data, a player could potentially use this to his advantage. There would necessarily be some historical data as winning selections are publicly disclosed. Thus, in Darkhorse Wagering there is an element of skill involved.

Figure 35:
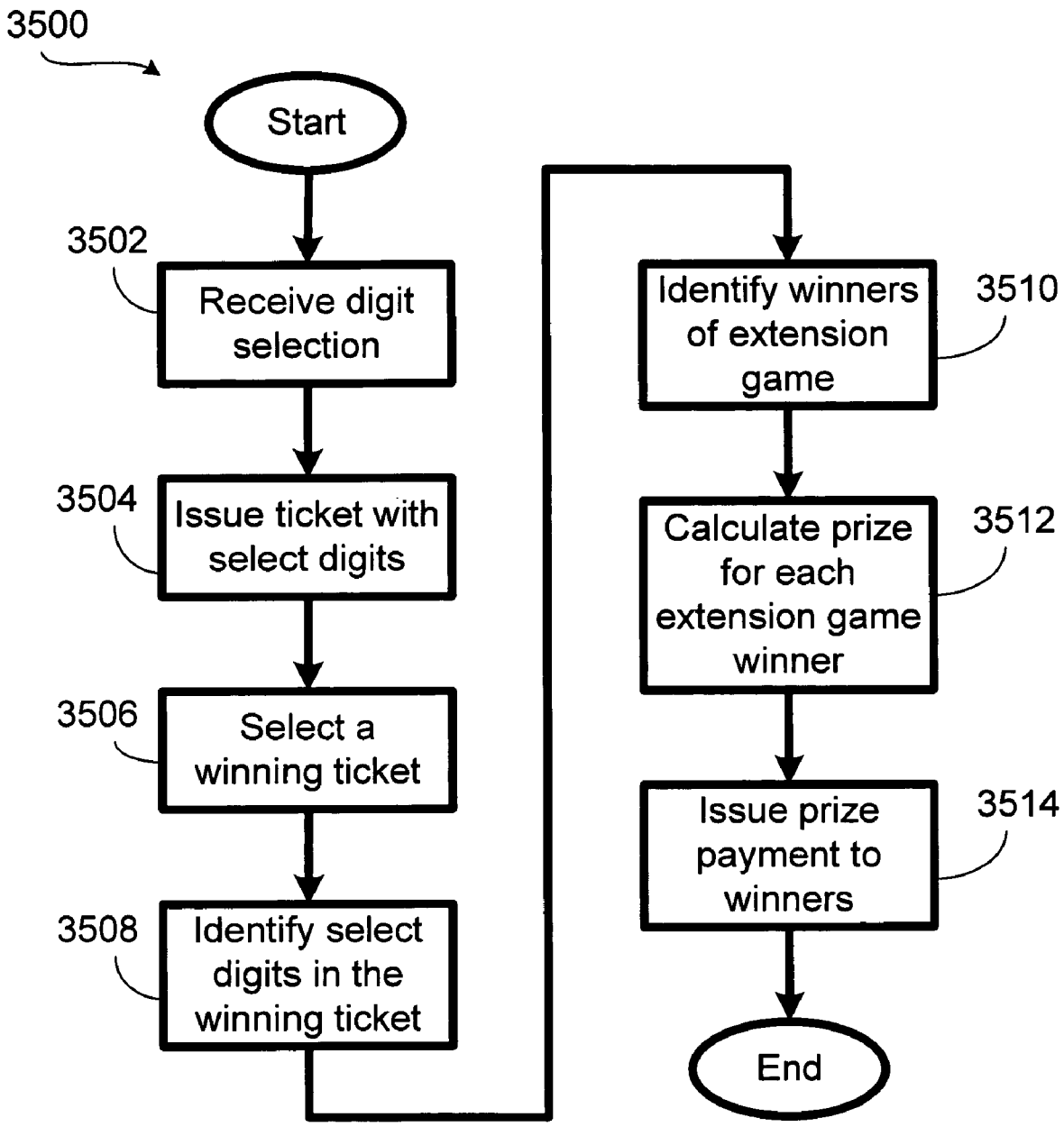
FIG. 35 illustrates a lottery authority server process.

FIG. 35 illustrates a lottery authority server process 3500. A player can elect to play a combination game that includes an extension (secondary) game and a base game, such as a raffle game. The player can purchase a base game ticket at a lottery terminal or a kiosk connected to a lottery authority server, and the lottery authority server offers the player the opportunity to play the extension game. If the player decides to play the extension game, he can select a set of digits or an animal at the lottery terminal or kiosk. The selected digits are transmitted to and received by the lottery authority server, step 3502. After the selected digits are received and payment received, the server issues a base game ticket with the selected digits, step 3504. The actual tickets may be printed at the lottery terminal with the information received from the lottery server.

At a predetermined time, the lottery authority selects a base game winner, step 3506. The base game winner can be selected through traditional methods, such as drawing a winning ticket from a barrel or obtaining numbered balls from different ball machines. Alternatively, the winner can also be determined by the lottery authority server. After the base game winner is determined, the lottery authority can identify the winning number of the extension game, step 3508. Once the winner number of the extension game is determined, the lottery authority server can easily check its record and determine winners of the extension game, step 3510, and calculate the prize for each extension game winner, step 3512. The prize for each extension game winner will be announced and the lottery authority can then pay prizes for each winner, step 3514. The prize can also be paid at the each lottery terminal upon presentation of a ticket with the winning extension game number.

Although several preferred embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed herein, and that many modifications and other embodiments of the inventions are intended to be included within the scope of the appended claims. Moreover, although specific terms are employed herein, as well as in the claims, they are used in a generic and descriptive sense only, and not for the purposes of limiting the described invention, nor the claims which follow below.

What is claimed is:

1. A method of playing a lottery game with a plurality of lottery game players, said method comprising the steps of:

playing a base game; receiving a base game entry, the base game having a plurality of lottery game players, the base game entry having a base game indicia and a second game indicia;

electing to play a second lottery game in addition to the base game; selecting a second game indicia for said second game;

selecting a winning base game indicia for the base game;

determining a winning base entry game based on the winning game indicia;

selecting a winning second game indicia for the second game to be the second game indicia on the winning base game entry;

comparing said winning second game indicia to the second game indicia of additional lottery players that elected to play the second game so that winners of the second game are determined based on matches with the second game indicia for the second game on the winning base game entry; and awarding prizes to winners of the base game only, the second game only, and both the base game and the second game.

2. The method of claim 1, further comprising the step of the second game indicia being selected for a lottery player electing to play the second game.

3. The method of claim 1, the base game comprising a raffle for which there is exactly one winner.

4. The method of claim 3, the second game comprising a selecting an object from a set of objects.

5. The method of claim 4 wherein the selecting an object from a set of objects comprises a digits game.

6. The method of claim 3, further comprising the step of forming a pari-mutuel pool to award prizes in the second game based on the number of base game entrants electing to play the second game.

7. A method for playing a lottery game, comprising the steps of:

receiving a first set of game indicia for a base game from a player;

receiving a set of extension game indicia for an extension game to the base game from the player;

issuing a game ticket for the base game to the player, the game ticket having the set of extension game indicia;

selecting a winning ticket for the base game;

assigning extension game winning indicia for the extension game as that corresponding to the winning ticket for the base game; and determining a prize for each game ticket having the extension game winning game indicia.

8. The method of claim 7, further comprising the step of offering the player an opportunity to play the extension game.

9. The method of claim 7, further comprising the step of issuing a payment for each game ticket having the extension game winning game indicia.

10. The method of claim 7, wherein the step of determining a prize for each game ticket further comprising the step of forming a pari-mutuel pool based on the number of base game entrants electing to play the extension game.

11. The method of claim 7, wherein the extension game comprises selecting a symbol from a set of symbols.

12. The method of claim 11, the said selecting an object from a set of objects comprises a digits game.

13. A system for playing an extension game to a lottery game, comprising:

a plurality of game terminals, each terminal being capable of accepting lottery game entries from players and offering a player an opportunity to play an extension game to the lottery game; and a lottery game server in communication with the plurality of game terminals, the lottery game server being capable of:

receiving a set of extension game indicia for the extension game from a player;

issuing a game ticket for the lottery game to the player, the game ticket having a predetermined game lottery indicia and the set of selected extension game indicia;

selecting a winning lottery game indicia for the lottery game;

determining a winning lottery game entry based on the winning lottery game indicia;

assigning winning extension game indicia for the extension game as that corresponding to the set of selected extension game indicia on the winning lottery entry;

determining a prize for each lottery game entry having the winning extension game indicia.

14. A method for playing a combination game, comprising the steps of:

receiving a first set of game indicia for a base game from a player;

receiving a second set of game indicia for an extension game to the base game from the player;

issuing a game ticket for the base game to the player, the game ticket having the first set of game indicia, the second set of game indicia, and an automatically generated raffle number;

randomly selecting a raffle number;

determining a winning ticket based on the selected raffle number;

determining an outcome for the base game;

assigning winning indicia for the second game as that corresponding to the second set of game indicia on the winning ticket that matches the selected raffle number; and determining a prize for each game ticket having the said winning game indicia.

15. The method of claim 14, further comprising the step of determining a prize for each ticket according to the outcome of the base game.

16. The method of claim 14, further comprising the step of offering the player an opportunity to play the extension game.

17. The method of claim 14, further comprising the step of issuing a payment for each game ticket having the winning game indicia.

18. The method of claim 14, wherein the step of determining a prize for each game ticket further comprising the step of forming a pari-mutuel pool based on the number of base game entrants electing to play the extension game.

19. The method of claim 14, wherein the extension game comprises selecting an object from a set of objects.

20. The method of claim 19 wherein the extension game the selecting an object from a set of objects comprises a digits game.

21. The method of claim 14, wherein the base game is a standard lottery game.

22. The method of claim 21 wherein prizes for the base game are enhanced based on whether or not the player also won the extension game.

* * * * *